US010541076B2

(12) United States Patent
Park et al.

(10) Patent No.: US 10,541,076 B2
(45) Date of Patent: Jan. 21, 2020

(54) POWER INDUCTOR

(71) Applicant: MODA-INNOCHIPS CO., LTD., Ansan-Si, Gyeonggi-Do (KR)

(72) Inventors: In Kil Park, Seongnam-Si (KR); Tae Hyung Noh, Siheung-Si (KR); Gyeong Tae Kim, Ansan-Si (KR); Seung Hun Cho, Siheung-Si (KR); Jun Ho Jung, Siheung-Si (KR); Ki Joung Nam, Siheung-Si (KR); Jung Gyu Lee, Seoul (KR)

(73) Assignee: MODA-INNOCHIPS CO., LTD. (KR)

( * ) Notice: Subject to any disclaimer, the term of this patent is extended or adjusted under 35 U.S.C. 154(b) by 0 days.

(21) Appl. No.: 15/502,502

(22) PCT Filed: Aug. 5, 2015

(86) PCT No.: PCT/KR2015/008212

§ 371 (c)(1),
(2) Date: Feb. 7, 2017

(87) PCT Pub. No.: WO2016/021938

PCT Pub. Date: Feb. 11, 2016

(65) Prior Publication Data

US 2017/0236633 A1 Aug. 17, 2017

(30) Foreign Application Priority Data

Aug. 7, 2014 (KR) ..... 10-2014-0101508
Sep. 11, 2014 (KR) ..... 10-2014-0120128
Aug. 4, 2015 (KR) ..... 10-2015-0109871

(51) Int. Cl.
*H01F 5/00* (2006.01)
*H01F 27/22* (2006.01)
(Continued)

(52) U.S. Cl.
CPC ..... *H01F 27/22* (2013.01); *H01F 17/0013* (2013.01); *H01F 17/04* (2013.01);
(Continued)

(58) Field of Classification Search
USPC ..... 336/200
See application file for complete search history.

(56) References Cited

U.S. PATENT DOCUMENTS 5,712,047 A 1/1998 Aso et al.
5,850,682 A 12/1998 Ushiro
(Continued)

FOREIGN PATENT DOCUMENTS

CN 1258373 A 6/2000
CN 1801412 A 7/2006
(Continued)

OTHER PUBLICATIONS

International Search Report and Written Opinion for PCT/KR2015/004135 dated Jun. 30, 2015.
(Continued)

*Primary Examiner* — Ronald Hinson
(74) *Attorney, Agent, or Firm* — Renaissance IP Law Group LLP

(57) ABSTRACT

The present invention suggests a power inductor comprising: a body; at least one substrate provided on the inside of the body; at least one coil pattern provided on at least one surface of the substrate; and an insulating layer formed between the coil pattern and the body, wherein at least a part of the substrate is removed and the body is filled in a region where the substrate is removed.

21 Claims, 13 Drawing Sheets

(51) Int. Cl.

| | |
|---|---|
| ***H01F 27/29*** | (2006.01) |
| ***H01F 17/00*** | (2006.01) |
| ***H01F 17/04*** | (2006.01) |
| ***H01F 27/255*** | (2006.01) |
| ***H01F 27/28*** | (2006.01) |
| ***H01F 27/32*** | (2006.01) |
| ***H01F 27/24*** | (2006.01) |
| ***H01F 41/04*** | (2006.01) |
| ***H01F 41/12*** | (2006.01) |

(52) U.S. Cl.

CPC ..... *H01F 27/24* (2013.01); *H01F 27/255* (2013.01); *H01F 27/2804* (2013.01); *H01F 27/29* (2013.01); *H01F 27/292* (2013.01); *H01F 27/323* (2013.01); *H01F 27/324* (2013.01); *H01F 41/041* (2013.01); *H01F 41/122* (2013.01); *H01F 2017/048* (2013.01); *H01F 2027/2809* (2013.01)

(56) References Cited

U.S. PATENT DOCUMENTS

| | | | | |
|---|---|---|---|---|
| 5,889,445 | A | 3/1999 | Ritter et al. | |
| 6,218,925 | B1 | 4/2001 | Iwao | |
| 6,356,181 | B1 | 3/2002 | Kitamura | |
| 6,515,556 | B1 | 2/2003 | Kato et al. | |
| 6,768,410 | B1 | 7/2004 | Yazaki et al. | |
| 6,998,939 | B2 | 2/2006 | Nakayama et al. | |
| 7,084,730 | B2 | 8/2006 | Kitagawa | |
| 7,085,118 | B2 | 8/2006 | Inoue et al. | |
| 7,408,435 | B2 | 8/2008 | Nishikawa et al. | |
| 7,497,005 | B2 | 3/2009 | Forbes et al. | |
| 7,652,554 | B2 | 1/2010 | Moriai et al. | |
| 7,772,956 | B2 | 8/2010 | Toi et al. | |
| 8,471,668 | B2 | 6/2013 | Hsieh et al. | |
| 8,514,539 | B2 | 8/2013 | Asakawa et al. | |
| 9,263,786 | B2 | 2/2016 | Suga et al. | |
| 9,406,420 | B2 * | 8/2016 | Ohkubo | H01F 5/00 |
| 9,490,059 | B2 | 11/2016 | Nishio et al. | |
| 9,558,890 | B2 | 1/2017 | Hattori et al. | |
| 9,576,711 | B2 | 2/2017 | Yoon et al. | |
| 9,647,315 | B2 | 5/2017 | Yamatogi et al. | |
| 9,899,143 | B2 * | 2/2018 | Kim | H01F 17/0013 |
| 2002/0033561 | A1 | 3/2002 | Kawaguchi | |
| 2002/0105406 | A1 * | 8/2002 | Liu | H01F 17/0006 336/200 |
| 2003/0030994 | A1 | 2/2003 | Takaya et al. | |
| 2003/0134612 | A1 | 7/2003 | Nakayama et al. | |
| 2005/0080346 | A1 | 4/2005 | Gianchandani et al. | |
| 2007/0080769 | A1 | 4/2007 | Thiel et al. | |
| 2008/0058652 | A1 | 3/2008 | Payne | |
| 2009/0137067 | A1 | 5/2009 | Forbes et al. | |
| 2010/0052838 | A1 | 3/2010 | Matsuta et al. | |
| 2010/0301981 | A1 * | 12/2010 | Zeng | H01F 27/2885 336/105 |
| 2011/0007439 | A1 | 1/2011 | Asakawa et al. | |
| 2011/0178574 | A1 * | 7/2011 | Hardy | A61K 33/38 607/50 |
| 2011/0291790 | A1 | 12/2011 | Okumura et al. | |
| 2011/0308072 | A1 | 12/2011 | Ahn et al. | |
| 2012/0001719 | A1 | 1/2012 | Oshima et al. | |
| 2012/0146757 | A1 | 6/2012 | Tsai et al. | |
| 2012/0274432 | A1 | 11/2012 | Jeong et al. | |
| 2012/0274435 | A1 | 11/2012 | Jeong et al. | |
| 2013/0038417 | A1 | 2/2013 | Kim et al. | |
| 2013/0082812 | A1 * | 4/2013 | Yoo | H01F 5/003 336/200 |
| 2013/0162385 | A1 | 6/2013 | Kwak et al. | |
| 2013/0169401 | A1 | 7/2013 | Lee et al. | |
| 2013/0181799 | A1 | 7/2013 | Deville et al. | |
| 2013/0222101 | A1 * | 8/2013 | Ito | H01F 17/04 336/83 |
| 2013/0307655 | A1 | 11/2013 | Saito et al. | |
| 2013/0341758 | A1 | 12/2013 | Lee et al. | |
| 2014/0001397 | A1 | 1/2014 | Park et al. | |
| 2014/0022041 | A1 | 1/2014 | Park et al. | |
| 2014/0022042 | A1 | 1/2014 | Park et al. | |
| 2014/0028430 | A1 | 1/2014 | Lee et al. | |
| 2014/0050001 | A1 | 2/2014 | Inaba | |
| 2014/0077914 | A1 | 3/2014 | Ohkubo et al. | |
| 2014/0132387 | A1 | 5/2014 | Shin | |
| 2014/0176284 | A1 | 6/2014 | Lee et al. | |
| 2014/0184374 | A1 | 7/2014 | Park et al. | |
| 2014/0218150 | A1 | 8/2014 | Cho et al. | |
| 2014/0333401 | A1 | 11/2014 | Esaki et al. | |
| 2014/0333404 | A1 * | 11/2014 | Bae | H01F 17/0013 336/192 |
| 2014/0347773 | A1 | 11/2014 | Park et al. | |
| 2015/0070120 | A1 | 3/2015 | Nishio et al. | |
| 2015/0087945 | A1 | 3/2015 | Ziaie et al. | |
| 2015/0116966 | A1 | 4/2015 | Lee et al. | |
| 2015/0145616 | A1 | 5/2015 | Kim | |
| 2015/0145627 | A1 | 5/2015 | Sim et al. | |
| 2015/0213960 | A1 | 7/2015 | Moon et al. | |
| 2015/0255206 | A1 | 9/2015 | Han et al. | |
| 2015/0325362 | A1 | 11/2015 | Kumura et al. | |
| 2015/0340149 | A1 * | 11/2015 | Lee | H05K 1/181 174/260 |
| 2016/0055964 | A1 | 2/2016 | Park et al. | |
| 2016/0254086 | A1 | 9/2016 | Kim et al. | |

FOREIGN PATENT DOCUMENTS

| | | | |
|---|---|---|---|
| CN | 101017728 | A | 8/2007 |
| CN | 101152772 | A | 4/2008 |
| CN | 201950034 | U | 8/2011 |
| CN | 102969109 | A | 3/2013 |
| CN | 103035354 | A | 4/2013 |
| CN | 103180919 | A | 6/2013 |
| CN | 103456458 | A | 12/2013 |
| CN | 103515077 | A | 1/2014 |
| CN | 103578708 | A | 2/2014 |
| CN | 103035354 | B | 11/2016 |
| DE | 102005039379 | A1 | 3/2007 |
| JP | H0432214 | A | 2/1992 |
| JP | H0714715 | A | 1/1995 |
| JP | 08097045 | A | 4/1996 |
| JP | 08264323 | A | 10/1996 |
| JP | 10241942 | A | 9/1998 |
| JP | 11054336 | A | 2/1999 |
| JP | 11150357 | A | 6/1999 |
| JP | 11260618 | A | 9/1999 |
| JP | 2001057311 | A | 2/2001 |
| JP | 2001338813 | A | 12/2001 |
| JP | 2002231574 | A | 8/2002 |
| JP | 2002305108 | A | 10/2002 |
| JP | 2003059719 | A | 2/2003 |
| JP | 2003282328 | A | 10/2003 |
| JP | 2003297634 | A | 10/2003 |
| JP | 2004056112 | A | 2/2004 |
| JP | 2005038872 | A | 2/2005 |
| JP | 2005183952 | A | 7/2005 |
| JP | 2006147901 | A | 6/2006 |
| JP | 2006157738 | A | 6/2006 |
| JP | 2006273969 | A | 10/2006 |
| JP | 2006286934 | A | 10/2006 |
| JP | 2006310812 | A | 11/2006 |
| JP | 2007012969 | A | 1/2007 |
| JP | 2007067214 | A | 3/2007 |
| JP | 2007194474 | A | 8/2007 |
| JP | 2008072073 | A | 3/2008 |
| JP | 2008147403 | A | 6/2008 |
| JP | 2009049335 | A | 3/2009 |
| JP | 2009117479 | A | 5/2009 |
| JP | 2009302386 | A | 12/2009 |
| JP | 2010010536 | A | 1/2010 |
| JP | 2010080550 | A | 4/2010 |
| JP | 2010153445 | A | 7/2010 |
| JP | 2010209469 | A | 9/2010 |
| JP | 2011018756 | A | 1/2011 |
| JP | 2011504662 | A | 2/2011 |
| JP | 2011077157 | A | 4/2011 |

(56) References Cited

FOREIGN PATENT DOCUMENTS

| | | | |
|---|---|---|---|
| JP | 2011258608 | A | 12/2011 |
| JP | 2011530172 | A | 12/2011 |
| JP | 2012089765 | A | 5/2012 |
| JP | 2012109292 | A | 6/2012 |
| JP | 2012156461 | A | 8/2012 |
| JP | 2013042102 | A | 2/2013 |
| JP | 2013098282 | A | 5/2013 |
| JP | 2013521414 | A | 6/2013 |
| JP | 2013239542 | A | 11/2013 |
| JP | 2013251553 | A | 12/2013 |
| JP | 2014011467 | A | 1/2014 |
| JP | 2014013815 | A | 1/2014 |
| JP | 2014013824 | A | 1/2014 |
| JP | 2014503118 | A | 2/2014 |
| JP | 5450565 | B2 | 3/2014 |
| JP | 2014060284 | A | 4/2014 |
| JP | 2014107548 | A | 6/2014 |
| JP | 2014110425 | A | 6/2014 |
| JP | 2014130988 | A | 7/2014 |
| JP | 2016004917 | A | 1/2016 |
| KR | 100479625 | B1 | 3/2005 |
| KR | 20070032259 | A | 3/2007 |
| KR | 20120031754 | A | 4/2012 |
| KR | 20120120819 | A | 11/2012 |
| KR | 20120122589 | A | 11/2012 |
| KR | 20120122590 | A | 11/2012 |
| KR | 20130046108 | A | 5/2013 |
| KR | 101338139 | B1 | 12/2013 |
| KR | 20130135298 | A | 12/2013 |
| KR | 101352631 | B1 | 1/2014 |
| KR | 20140002355 | A | 1/2014 |
| KR | 20140003056 | A | 1/2014 |
| KR | 20140066437 | A | 6/2014 |
| KR | 20140085997 | A | 7/2014 |
| TW | 200915358 | A | 4/2009 |
| TW | 201346951 | A | 11/2013 |
| TW | 201346952 | A | 11/2013 |
| WO | 2013042691 | A1 | 3/2013 |
| WO | 2014087888 | A1 | 6/2014 |

OTHER PUBLICATIONS

International Search Report and Written Opinion for PCT/KR2015/004136 dated Jun. 30, 2015.
International Search Report and Written Opinion for PCT/KR2015/004137 dated Jun. 30, 2015.
International Search Report and Written Opinion for PCT/KR2015/004139 dated Jun. 29, 2015.
International Search Report and Written Opinion for PCT/KR2015/005454 dated Aug. 25, 2015.
International Search Report and Written Opinion for PCT/KR2015/008212 dated Nov. 17, 2015.
Extended European Search Report for Application No. 15829073.4 dated May 22, 2018.
Extended European Search Report for Application No. 15839158.1 dated May 24, 2018.
Extended European Search Report for Application No. 15839164.9 dated May 22, 2018.
Extended European Search Report for Application No. 15840080.4 dated Jun. 6, 2018.
Final Office Action for U.S. Appl. No. 15/509,849 dated Sep. 12, 2018.
Office Action for U.S. Appl. No. 15/502,501 dated Jun. 29, 2018.
Final Office Action for U.S. Appl. No. 15/509,850, dated Dec. 3, 2018.
Office Action for U.S. Appl. No. 15/502,500, dated May 31, 2019.
Office Action for U.S. Appl. No. 15/502,501, dated May 31, 2019.
Notice of Allowance for U.S. Appl. No. 15/509,849, dated Oct. 3, 2019.

* cited by examiner

POWER INDUCTOR

TECHNICAL FIELD

The present invention relates to a power inductor, and more particularly, to a power inductor having superior inductance properties and improved insulation properties and thermal stability.

BACKGROUND ART

A power inductor is mainly provided in a power circuit such as a DC-DC converter within a portable device. The power inductor is increasing in use instead of an existing wire wound choke coil as the power circuit is switched at a high frequency and miniaturized. Also, the power inductor is being developed in the manner of miniaturization, high current, low resistance, and the like as the portable device is reduced in size and multi-functionalized.

The power inductor according to the related art is manufactured in a shape in which a plurality of ferrites or ceramic sheets mode of a dielectric having a low dielectric constant are laminated. Here, a coil pattern is formed on each of the ceramic sheets, and thus, the coil pattern formed on each of the ceramic sheets is connected to the ceramic sheet by a conductive via, and the coil patterns overlap each other in a vertical direction in which the sheets are laminated. Also, in the related art, the body in which the ceramic sheets are laminated may be generally manufactured by using a magnetic material composed of a four element system of nickel (Ni), zinc (Zn), copper (Cu), and iron (Fe).

However, the magnetic material has a relatively low saturation magnetization value when compared to that of the metal material, and thus, the magnetic material may not realize high current properties that are required for the recent portable devices. As a result, since the body constituting the power inductor is manufactured by using metal powder, the power inductor may relatively increase in saturation magnetization value when compared to the body manufactured by using the magnetic material. However, if the body is manufactured by using the metal, an eddy current loss and a hysteresis loss of a high frequency wave may increase to cause serious damage of the material.

To reduce the loss of the material, a structure in which the metal powder is insulated from each other by a polymer may be applied. That is, sheets in which the metal powder and the polymer are mixed with each other are laminated to manufacture the body of the power inductor. Also, a predetermined base material on which a coil pattern is formed is provided inside the body. That is, the coil pattern is formed on the predetermined base material, and a plurality of sheets are laminated and compressed on upper and lower sides of the coil pattern to manufacture the power inductor.

However, there is a problem in which the power inductor manufactured by using the metal powder and the polymer is reduced in inductance due to an increase of a temperature. That is, the power inductor may increase in temperature by generation of heat of the portable device to which the power inductor is applied, and thus, the metal power forming the body of the power inductor may be heated to cause the problem in which the inductance is reduced. Also, the coil pattern and the metal powder within the body may contact each other in the body. Here, in order to preventing this phenomenon from occurring, the coil pattern and the body have to be insulated from each other.

Also, a base material on which the coil pattern is formed uses a material having magnetic permeability such as copper clad lamination CCL, and thus, the power inductor using the above-described base material may be reduced in magnetic permeability.

PRIOR ART DOCUMENTS

Korean Patent Publication No. 2007-0032259

DISCLOSURE OF THE INVENTION

Technical Problem

The present invention provides a power inductor that is capable of releasing heat within a body to improve stability in temperature and provide an inductance from being reduced.

The present invention also provides a power inductor that is capable of improving insulation between a coil pattern and a body.

The present invention also provides a power inductor that is capable of improving capacity and magnetic permeability.

Technical Solution

A power inductor according to an embodiment of the present invention includes: a body including metal powder, a polymer, and a thermal conductive filler; at least one base material provided in the body; at least one coil pattern disposed on at least one surface of the base material; and an insulation layer disposed between the coil pattern and the body.

A power inductor according to another embodiment of the present invention includes: a body; at least one base material provided in the body; at least one coil pattern disposed on at least one surface of the base material; and an insulation layer disposed between the coil pattern and the body, wherein at least a portion of a region of the base material is removed, and the body is filled into the removed region. The body may include metal power, a polymer, and a thermal conductive filler.

The metal powder may include metal alloy powder including iron.

A surface of the metal powder may be coated with at least one of a magnetic material and an insulation material.

The thermal conductive filler may include at least one selected from the group consisting of MaO, AlN, and carbon-based materials.

The thermal conductive filler may have a content of 0.5 wt % to 3 wt % with respect to 100 wt % of the metal powder and has a size of 0.5 μm to 100 μm.

The base material may be formed through copper clad lamination or formed by bonding copper foil on both surfaces of a metal plate.

The base material may be manufactured by removing inner and outer regions of the coil pattern.

The base material may have a concavely curved surface with respect to a side surface of the body by removing an entire outer region of the coil pattern.

The coil patterns may be respectively disposed on one surface and the other surface of the base material and connected to each other through a conductive via defined in the base material.

The coil patterns disposed on the one surface and the other surface of the base material may have the same height, which is greater by 2.5 times than a thickness of the base material.

The insulation layer may be made of parylene at a uniform thickness on top and bottom surfaces of the coil pattern.

The insulation layer may be further provided on the base material at the same thickness as that of each of the top and bottom surfaces of the coil pattern.

The coil pattern may be withdrawn to a central portion of two sides facing each other of the body and connected to an external electrode disposed outside the body.

At least two base materials may be provided and laminated in a thickness direction of the body.

The coil patterns respectively disposed on the at least two base materials may be connected in series or parallel to each other.

The coil patterns respectively disposed on the at least two base materials may be connected to each other in series by a connection electrode disposed outside the body.

The coil patterns respectively disposed on the at least two base materials may be withdrawn in directions different from each other and connected to external electrodes different from each other.

At least two base materials may be provided and arranged in a direction perpendicular to a thickness direction of the body.

The coil patterns respectively disposed on the at least two base materials may be withdrawn in directions different from each other and connected to external electrodes different from each other.

The power inductor may further include a magnetic layer disposed on at least one area of the body and having magnetic permeability greater than that of the body, and the magnetic layer may include the thermal conductive filler.

Advantageous Effects

In the power inductor according to the embodiments of the present invention, the body may be manufactured by the metal powder, the polymer, and the thermal conductive filler. The thermal conductive filler may be provided to well release the heat of the body to the outside, and thus, the reduction of the inductance due to the heating of the body may be prevented.

Also, since the parylene is applied on the coil pattern, the parylene having the uniform thickness may be formed on the coil pattern, and thus, the insulation between the body and the coil pattern may be improved.

Also, the base material that is provided inside the body and on which the coil pattern is formed may be manufactured by using the metal magnetic material to prevent the power inductor from being deteriorated in magnetic permeability. In addition, at least a portion of the base material may be removed to fill the body in the removed portion of the base material, thereby improving the magnetic permeability. Also, at least one magnetic layer may be disposed on the body to improve the magnetic permeability of the power inductor.

Also, the at least two base materials of which the coil pattern having the coil shape is disposed on at least one surface to form the plurality of coil within one body, thereby increasing the capacity of the power inductor.

MODE FOR CARRYING OUT THE INVENTION

Hereinafter, embodiments of the present invention will be described in detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art.

Figure 1:
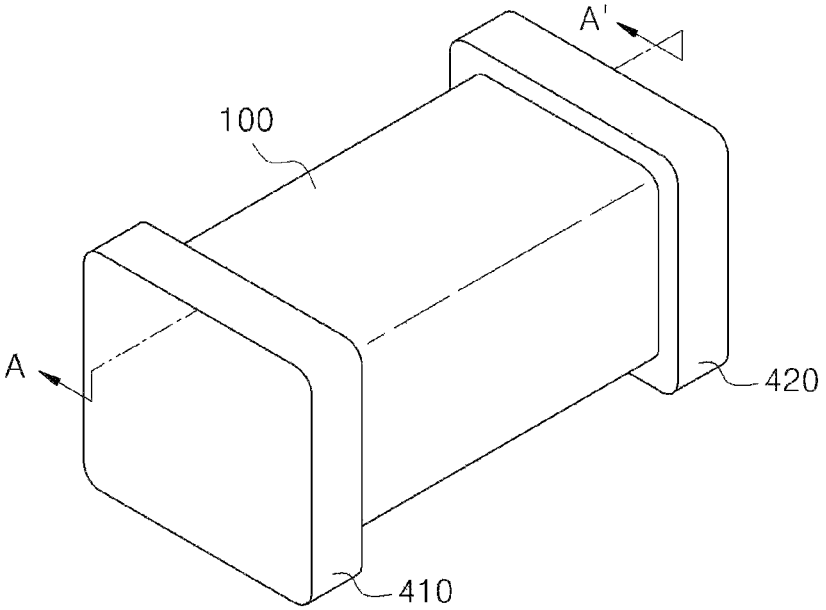
FIG. 1 is a combined perspective view of a power inductor according to a first embodiment of the present invention.
Figure 2:
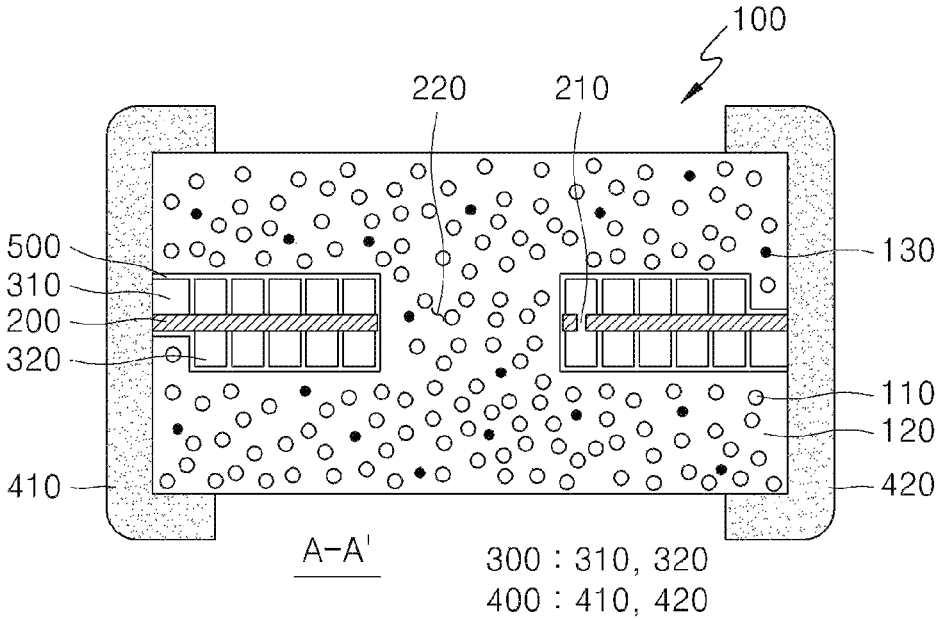
FIG. 2 is a cross-sectional view taken along line A-A' of FIG. 1.
Figure 3:
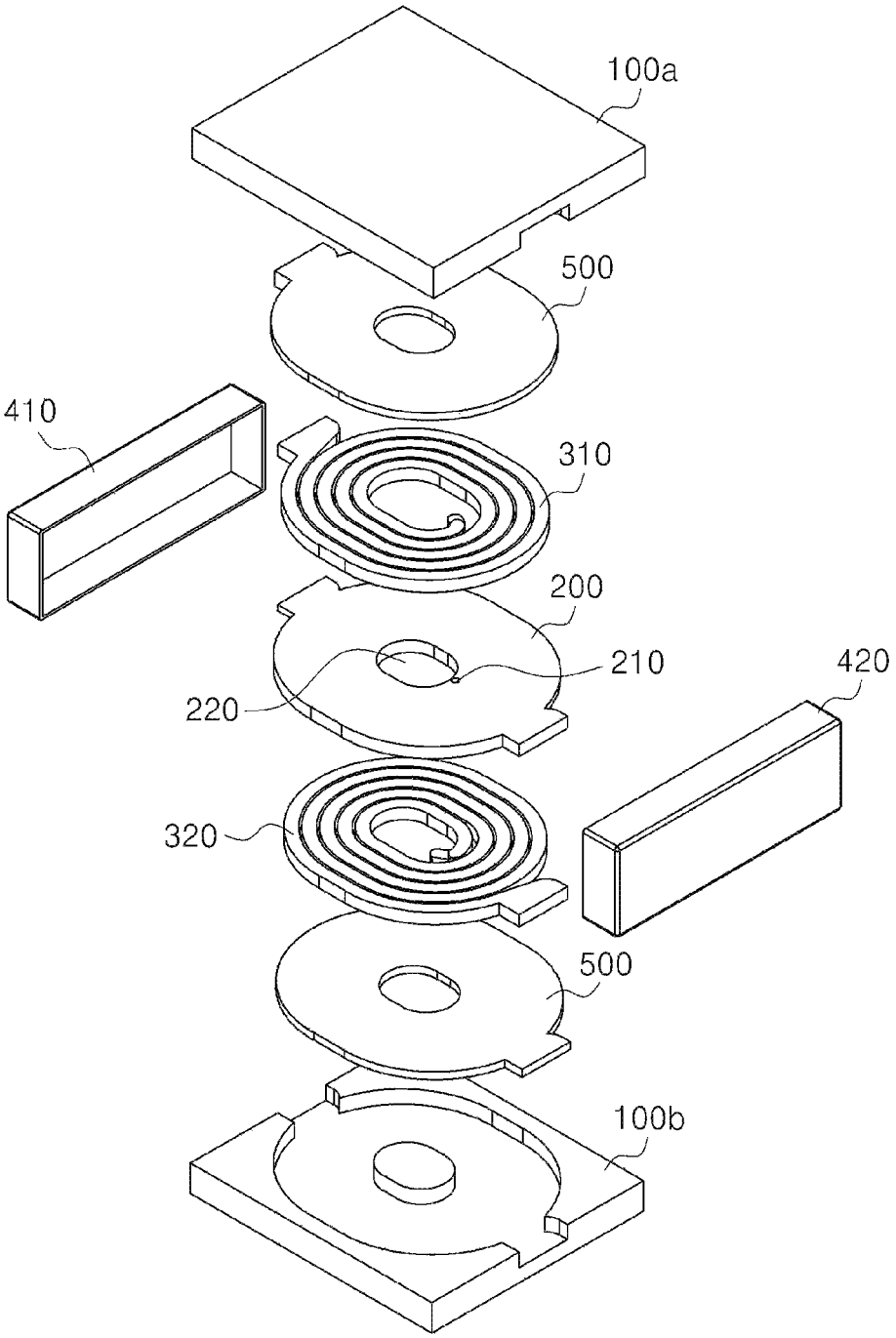
FIGS. 3 and 4 are an exploded perspective view and a partial plan view of the power inductor according to the first embodiment of the present invention.
Figure 4:
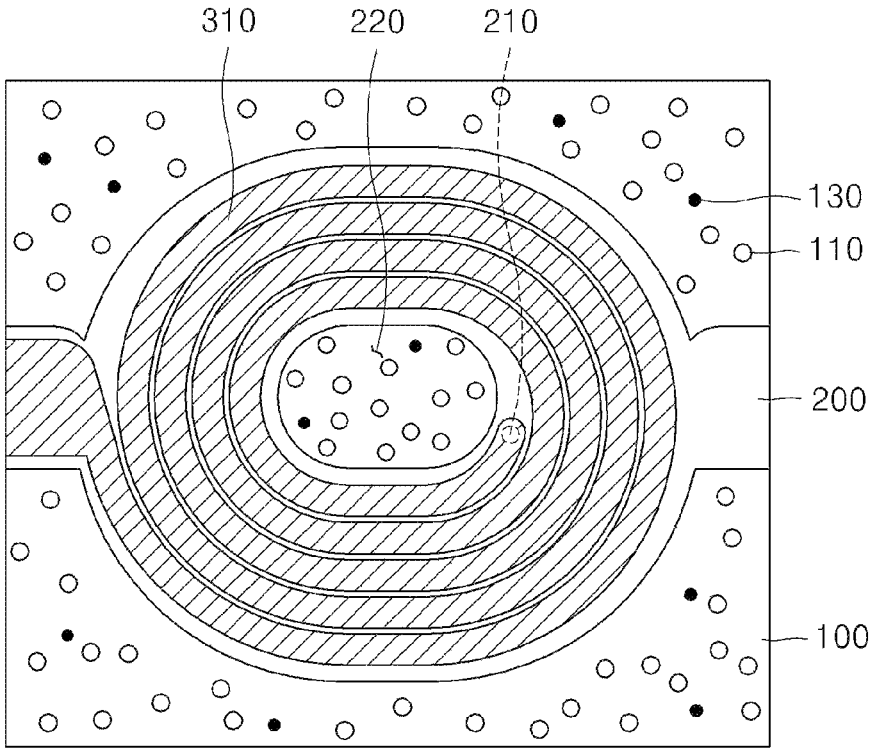

FIG. 1 is a combined perspective view of a power inductor according to a first embodiment of the present invention, and FIG. 2 is a cross-sectional view taken along line A-A' of FIG. 1. Also, FIGS. 3 and 4 are an exploded perspective view and a partial plan view of the power inductor according to the first embodiment of the present invention, and FIG. 4 is a plan view of a base material and a coil pattern.

Referring to FIGS. 1 to 4, a power inductor according to the first embodiment of the present invention may include a body 100 (100*a* and 100*b*), a base material 200 provided in the body 100, a coil pattern 300 (310 and 320) disposed on at least one surface of the base material 200, and an external electrode 400 (410 and 420) disposed outside the body 100. Also, an insulation layer 500 may be further disposed between the coil pattern 300 (310 and 320) and the body 100.

The body 100 may have a hexahedral shape. Of course, the body 100 may have a polyhedral shape in addition to the hexahedral shape. The body 100 may include metal powder 110 and a polymer 120 and may further include a thermal conductive filler 130.

The metal powder 110 may have a mean particle diameter of 1 μm to 50 μm. Also, one kind of particles having the same size or at least two kinds of particles may be used as the metal powder 110, or one kind of particles having a plurality of sizes or at least two kinds of particles may be used as the metal powder 110. For example, first metal particles having a mean size of 30 μm and second metal particles having a mean size of 3 μm may be mixed with each other, and then, the mixture may be used as the metal powder 110. Here, the first and second metal particles may be particles of the same material and particles of materials different from each other. When the at least two kinds of metal magnetic powder 110 having sizes different from each other are used, the body 100 may increase in filling rate and thus maximized in capacity. For example, in case of using the metal power having the mean size of 30 μm, a pore may be generated between the metal powder, and thus, the filling rate may be reduced. However, the metal power having the size of 3 μm may be mixed between the metal powder having the size of 30 μm to increase the filling rate of the metal powder within the body 110. The metal powder 110 may use a metal material including iron (Fe), for example, may include at least one metal selected from the group consisting of Fe—Ni, Fe—Ni—Si, Fe—Al—Si, and Fe—Al—Cr. That is, the metal powder 110 may include iron to have a magnetic tissue or be formed of a metal alloy having magnetic properties to have predetermined magnetic permeability. Also, a surface of the metal powder 110 may be coated with a magnetic material, and the magnetic material may have magnetic permeability different from that of the metal powder 110. For example, the magnetic materials may include a metal oxide magnetic material. The metal oxide magnetic material may include at least one selected from the group consisting of a Ni oxide magnetic material, a Zn oxide magnetic material, a Cu oxide magnetic material, a Mn oxide magnetic material, a Co oxide magnetic material, a Ba oxide magnetic material, and a Ni—Zn—Cu oxide magnetic material. That is, the magnetic material applied to the surface of the metal powder 110 may include metal oxide including iron and have magnetic permeability greater than that of the metal powder 110. Since the metal powder 110 has magnetism, when the metal powder 110 contact each other, the insulation therebetween may be broken to cause short-circuit. Thus, the surface of the metal powder 110 may be coated with at least one insulation material. For example, the surface of the metal powder 110 may be coated with oxide or an insulative polymer material such as parylene, and preferably, the surface of the metal powder 110 may be coated with the parylene. The parylene may be coated to a thickness of 1 μm to 10 μm. Here, when the parylene is formed to a thickness of 1 μm or less, an insulation effect of the metal powder 110 may be deteriorated. When the parylene is formed to a thickness exceeding 10 μm, the metal powder 110 may increase in size to reduce distribution of the metal powder 110 within the body 100, thereby deteriorating the magnetic permeability. Also, the surface of the metal powder 110 may be coated with various insulative polymer materials in addition to the parylene. The oxide applied to the metal powder 110 may be formed by oxidizing the metal powder 110, and the metal powder 110 may be coated with at least one selected from $TiO_2$, $SiO_2$, $ZrO_2$, $SnO_2$, NiO, ZnO, CuO, CoO, MnO, MgO, $Al_2O_3$, $Cr_2O_3$, $Fe_2O_3$, $B_2O_3$, and $Bi_2O_3$. Here, the metal powder 110 may be coated with oxide having a double structure, for example, may be coated with a double structure of the oxide and the polymer material. Alternatively, the surface of the metal powder 110 may be coated with an insulation material after being coated with the magnetic material. Since the surface of the metal powder 110 is coated with the insulation material, the short circuit due to the contact between the metal powder 110 may be prevented. Here, when the metal powder 100 is coated with the oxide and the insulation polymer or doubly coated with the magnetic material and the insulation material, the coating material may be coated to a thickness of 1 μm to 10 μm.

The polymer 120 may be mixed with the metal powder 110 to insulate the metal power 110 from each other. That is, the metal power 110 may increase in eddy current loss and hysterical loss at a high frequency to cause a problem in which a material loss increases, and thus, to reduce the material loss, the polymer 120 may be provided to insulate the metal powder 110 from each other. The polymer 120 may include at least one polymer selected from the group consisting of epoxy, polyimide, and liquid crystalline polymer (LCP), but is not limited thereto. Also, the polymer 120 may be made of a thermosetting resin to provide insulation between the metal powder 110. For example, the thermosetting resin may include at least one selected from the group consisting of a novolac epoxy resin, a phenoxy type epoxy resin, a BPA type epoxy resin), a BPF type epoxy resin), a hydrogenated BPA epoxy resin), a dimer acid modified epoxy resin, an urethane modified epoxy resin), a rubber modified epoxy resin, and a DCPD type epoxy resin. Here, the polymer 120 may be contained at a content of 2.0 wt % to 5.0 wt % with respect to 100 wt % of the metal powder 110. However, if the content of the polymer 120 increases, a volume fraction of the metal powder 110 may be reduced, and thus, it is difficult to properly realize an effect in which a saturation magnetization value increases. Thus, the magnetic permeability of the body 100 may be deteriorated. On the other hand, if the content of the polymer 120 decreases, a strong acid solution or a strong alkali solution that is used in a process of manufacturing the inductor may be permeated inward to reduce inductance properties. Thus, the polymer 120 may be contained within a range in which the saturation magnetization value and the inductance of the metal powder 110 are not reduced.

The body 100 may include a thermal conductive filler 130 to solve the limitation in which the body 100 is heated by external heat. That is, the metal powder 110 of the body 100 may be heated by external heat, and thus, the thermal conductive filler 130 may be provided to easily release the heat of the metal powder 110 to the outside. The thermal conductive filler 130 may include at least one selected from the group consisting of MgO, AlN, carbon-based materials, but is not limited thereto. Here, the carbon-based material may include carbon and have various shapes, for example, include graphite, carbon black, graphene, and the like. Also, the thermal conductive filler 130 may be contained at a content of 0.5 wt % to 3 wt % with respect to 100 wt % of the metal powder 110. When the thermal conductive filler 130 has a content less than the above-described range, it may be difficult to obtain a heat releasing effect. On the other hand, when the thermal conductive filler 130 has a content exceeding the above-described range, a content of the metal powder 110 may be reduced to deteriorate the magnetic permeability of the body 100. Also, the thermal conductive filler 130 may have a size of, for example, 0.5 μm to 100 μm. That is, the thermal conductive filler 130 may have the same size as metal powder 110 or a size greater or less than that of the metal powder 110. The heat releasing effect may be adjusted according to a size and content of the thermal conductive filler 130. For example, the more the size and content of the thermal conductive filler 130 increase, the more the heat releasing effect may increase. The body 100 may be manufactured by laminating a plurality of sheets, which are made of a material including the metal powder 110, the polymer 120, and the thermal conductive filler 130. Here, when the plurality of sheets are laminated to manufacture the body 100, the thermal conductive fillers 130 of the sheets may have contents different from each other. For example, the more the thermal conductive filler 130 is gradually away upward and downward from the center of the base material 200, the more the content of the thermal conductive filler 130 within the sheet may gradually increase. Also, the body 100 may be manufactured by various methods such as a method of printing of paste, which is made of the metal powder 110, the polymer 120, and the thermal conductive filler 130, at a predetermined thickness and a method of pressing the paste into a frame. Here, the number of laminated sheet or the thickness of the paste printed to the predetermined thickness so as to form the body 100 may be determined in consideration of electrical characteristics such as an inductance required for the power inductor. The bodies 100*a* and 100*b* disposed on upper and lower portions of the base material 200 with the base material 200 therebetween may be connected to each other through the base material 200. That is, at least a portion of the base material 200 may be removed, and then a portion of the body 100 may be filled into the removed portion of the base material 200. Since at least a portion of the base material 200 is removed, and the body 100 is filled into the removed portion, the base material 200 may be reduced in surface area, and a rate of the body 100 in the same volume may increase to improve the magnetic permeability of the power inductor.

The base material 200 may be provided in the body 100. For example, the base material 200 may be provided in the body 100 in a long axis direction of the body 100, i.e., a direction of the external electrode 400. Also, at least one base material 200 may be provided. For example, at least two base materials 200 may be spaced a predetermined distance from each other in a direction perpendicular to a direction in which the external electrode 400 is disposed, for example, in a vertical direction. Of course, at least two base materials 200 may be arranged in the direction in which the external electrode 400 is disposed. For example, the base material 200 may be manufactured by using copper clad lamination (CCL) or metal magnetic body. Here, the base material 200 may be manufactured by using the metal magnetic body to improve the magnetic permeability and facilitate capacity realization. That is, the CCL is manufactured by bonding copper foil to a glass reinforced fiber. Since the CCL has the magnetic permeability, the power inductor may be deteriorated in magnetic permeability. However, when the metal magnetic body is used as the base material 200, since the metal magnetic body has the magnetic permeability, the power inductor may not be deteriorated in magnetic permeability. The base material 200 using the metal magnetic body may be manufactured by bonding copper foil to a plate having a predetermined thickness, which is made of a metal containing iron, e.g., at least one metal selected from the group consisting of Fe—Ni, Fe—Ni—Si, Fe—Al—Si, and Fe—Al—Cr. That is, an alloy made of at least one metal containing iron may be manufactured in a plate shape having a predetermined thickness, and copper foil may be bonded to at least one surface of the metal plate to manufacture the base material 200.

Also, at least one conductive via 210 may be defined in a predetermined area of the base material 200. The coil patterns 310 and 320 disposed on the upper and lower portions of the base material 200 may be electrically connected to each other through the conductive via 210. A via (not shown) passing through the base material 200 in a thickness direction of the base material 200 may be formed in the base material 200, and then the paste may be filled into the via to form the conductive via 210. Here, at least one of the coil patterns 310 and 320 may be grown from the conductive via 210, and thus, at least one of the coil patterns 310 and 320 may be integrated with the conductive via 210. Also, at least a portion of the base material 200 may be removed. That is, at least a portion of the base material 200 may be removed or may not be removed. As illustrated in FIGS. 3 and 4, an area of the base material 200, which remains except for an area overlapping the coil patterns 310 and 320, may be removed. For example, the base material 200 may be removed to form the through hole 220 inside the coil patterns 310 and 320 each of which has a spiral shape, and the base material 200 outside the coil patterns 310 and 320 may be removed. That is, the base material 200 may have a shape along an outer appearance of each of the coil patterns 310 and 320, e.g., a racetrack shape, and an area of the base material 200 facing the external electrode 400 may have a linear shape along a shape of an end of each of the coil patterns 310 and 320. Thus, the outside of the base material 200 may have a shape that is curved with respect to an edge of the body 100. As illustrated in FIG. 4, the body 100 may be filled into the removed portion of the base material 200. That is, the upper and lower bodies 100*a* and 100*b* may be connected to each other through the removed region including the through hole 220 of the base material 200. When the base material 200 is manufactured using the metal magnetic material, the base material 200 may contact the metal powder 110 of the body 100. To solve the above-described limitation, the insulation layer 500 such as parylene may be disposed on a side surface of the base material 200. For example, the insulation layer 500 may be disposed on a side surface of the through hole 220 and an outer surfaces of the base material 200. The base material 200 may have a width greater than that of each of the coil patterns 310 and 320. For example, the base material 200 may remain with a predetermined width in a directly downward direction of the coil patterns 310 and 320. For example, the base material 200 may protrude by a height of about 0.3 μm from each of the coil patterns 310 and 320. Since the base material 200 outside and inside the coil patterns 310 and 320 is removed, the base material 200 may have a cross-sectional area less than that of the body 100. For example, when the cross-sectional area of the body 100 is defined as a value of 100, the base material 200 may have an area ratio of 40 to 80. If the area ratio of the base material 200 is high, the magnetic permeability of the body 100 may be reduced. On the other hand, if the area ratio of the base material 200 is low, the formation area of the coil patterns 310 and 320 may be reduced. Thus, the area ratio of the base material 200 may be adjusted in consideration of the magnetic permeability of the body 100 and a line width and turn number of each of the coil patterns 310 and 320.

The coil pattern 300 (310 and 320) may be disposed on at least one surface, preferably, both side surfaces of the base material 200. Each of the coil patterns 310 and 320 may be formed in a spiral shape on a predetermined area of the base material 200, e.g., outward from a central portion of the base material 200, and the two coil patterns 310 and 320 disposed on the base material 200 may be connected to each other to form one coil. That is, each of the coil patterns 310 and 320 may have a spiral shape from the outside of the through hole 220 defined in the central portion of the base material 200. Also, the coil patterns 310 and 320 may be connected to each other through the conductive via 210 provided in the base material 200. Here, the upper coil pattern 310 and the lower coil pattern 320 may have the same shape and the same height. Also, the coil patterns 310 and 320 may overlap each other. Alternatively, the coil pattern 320 may be disposed to overlap an area on which the coil pattern 310 is not disposed. An end of each of the coil patterns 310 and 320 may extend outward in a linear shape and also extend along a central portion of a short side of the body 100. Also, an area of each of the coil patterns 310 and 320 contacting the external electrode 400 may have a width greater than that of the other area as illustrated in FIGS. 3 and 4. Since a portion of each of the coil patterns 310 and 320, i.e., a lead-out part has a relatively wide width, a contact area between each of the coil patterns 310 and 320 and the external electrode 400 may increase to reduce resistance. Alternatively, each of the coil patterns 310 and 320 may extend in a width direction of the external electrode 400 from one area on which the external electrode 400 is disposed. Here, the lead-out part that is led out toward a distal end of each of the coil patterns 310 and 320, i.e., the external electrode 400 may have a linear shape toward a central portion of the side surface of the body 100.

The coil patterns 310 and 320 may be electrically connected to each other by the conductive via 210 provided in the base material 200. The coil patterns 310 and 320 may be formed through methods such as, for example, thick-film printing, coating, deposition, plating, and sputtering. Here, the coil patterns 310 and 320 may preferably formed through the plating. Also, each of the coil patterns 310 and 320 and the conductive via 210 may be made of a material including at least one of silver (Ag), copper (Cu), and a copper alloy, but is not limited thereto. When the coil patterns 310 and 320 are formed through the plating process, a metal layer, e.g., a cupper layer is formed on the base material 200 through the plating process and then patterned through a lithography process. That is, the copper layer may be formed by using the copper foil disposed on the surface of the base material 200 as a seed layer and then patterned to form the coil patterns 310 and 320. Alternatively, a photosensitive pattern having a predetermined shape may be formed on the base material 200, and the plating process may be performed to grow a metal layer from the exposed surface of the base material 200, thereby forming the coil patterns 310 and 320, each of which has a predetermined shape. The coil patterns 310 and 320 may be formed with a multilayer structure. That is, a plurality of coil patterns may be further disposed above the coil pattern 310 disposed on the upper portion of the base material 200, and a plurality of coil patterns may be further disposed below the coil pattern 320 disposed on the lower portion of the base material 200. When the coil patterns 310 and 320 are formed with the multilayer structure, the insulation layer may be disposed between a lower layer and an upper layer. Then, the conductive via (not shown) may be formed in the insulation layer to connect the multilayered coil patterns to each other. Each of the coil patterns 310 and 320 may have a height that is greater 2.5 times than a thickness of the base material 200. For example, the base material may have a thickness of 10 μm to 50 μm, and each of the coil patterns 310 and 320 may have a height of 50 μm to 300 μm.

The external electrodes 410 and 420 (400) may be disposed on two surface facing each other of the body 100. For example, the external electrodes 400 may be disposed on two side surfaces of the body 100, which face each other in a long axis direction. The external electrode 400 may be electrically connected to the coil patterns 310 and 320 of the body 100. Also, the external electrodes 410 and 420 may be disposed on the two side surfaces of the body 100 to contact the coil patterns 310 and 320 at central portions of the two side surfaces, respectively. That is, an end of each of the coil patterns 310 and 320 may be exposed to the outer central portion of the body 100, and the external electrode 400 may be disposed on the side surface of the body 100 and then connected to the end of each of the coil patterns 310 and 320. The external electrodes 400 may be formed by immersing the body 100 into the conductive paste or formed on both ends of the body 100 through various methods such as printing, deposition, and sputtering. Each of the external electrodes 400 may be made of a metal having electrical conductivity, e.g., at least one metal selected from the group consisting of gold, silver, platinum, copper, nickel, palladium, and an alloy thereof. Also, each of the external electrodes 400 may further include a nickel-plated layer (not shown) and a tin-plated layer (not shown).

Figure 5:
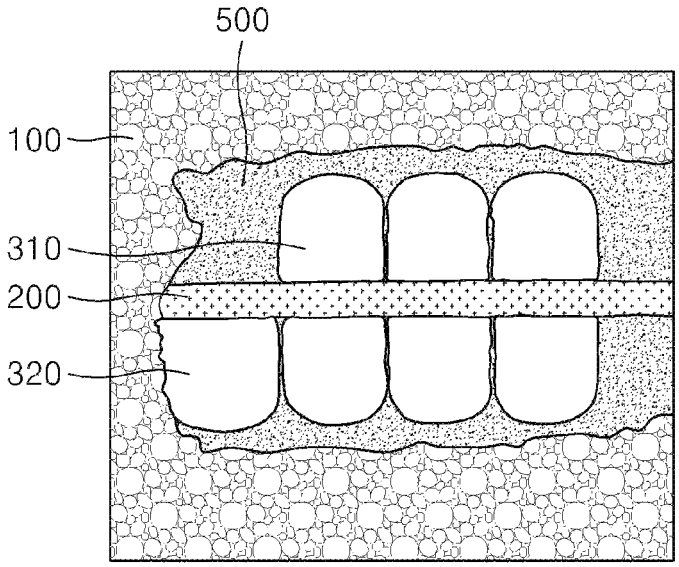
FIGS. 5 and 6 are cross-sectional views of the power inductor depending on materials of an insulation layer.
Figure 6:
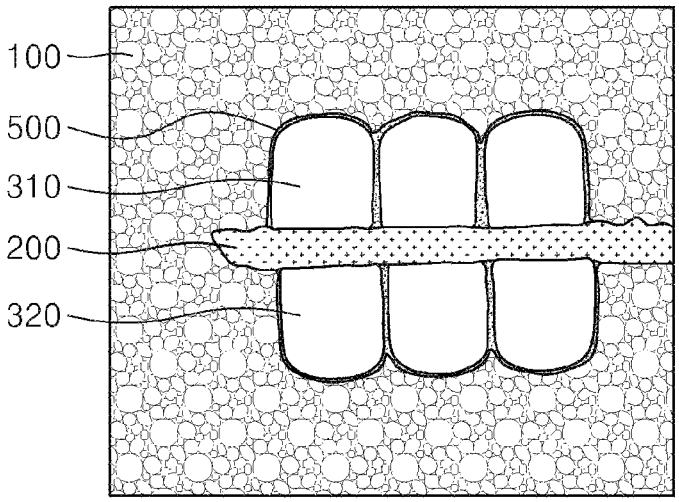

The insulation layer 500 may be disposed between the coil patterns 310 and 320 and the body 100 to insulate the coil patterns 310 and 320 from the metal powder 110. That is, the insulation layer 500 may cover the top and side surfaces of each of the coil patterns 310 and 320. Also, the insulation layer 500 may cover the base material 200 as well as the top and side surfaces of each of the coil patterns 310 and 320. That is, the insulation layer 500 may be formed on an area exposed by the coil patterns 310 and 320 of the base material 200 of which a predetermined region is removed, i.e., a surface and side surface of the base material 200. The insulation layer 500 on the base material 200 may have the same thickness as the insulation layer 500 on the coil patterns 310 and 320. The insulation layer 500 may be formed by applying the parylene on each of the coil patterns 310 and 320. For example, the base material 200 on which the coil patterns 310 and 320 are formed may be provided in a deposition chamber, and then, the parylene may be vaporized and supplied into the vacuum chamber to deposit the parylene on the coil patterns 310 and 320. For example, the parylene may be primarily heated and vaporized in a vaporizer to become a dimer state and then be secondarily heated and pyrolyzed into a monomer state. Then, when the parylene is cooled by using a cold trap connected to the deposition chamber and a mechanical vacuum pump, the parylene may be converted from the monomer state to a polymer state and thus be deposited on the coil patterns 310 and 320. Alternatively, the insulation layer 500 may be formed of an insulation polymer in addition to the parylene, for example, at least one material selected from epoxy, polyimide, and liquid crystal crystalline polymer. However, the parylene may be applied to form the insulation layer 500 having the uniform thickness on the coil patterns 310 and 320. Also, although the insulation layer 500 has a thin thickness, the insulation property may be improved when compared to other materials. That is, when the insulation layer 500 is coated with the parylene, the insulation layer 500 may have a relatively thin thickness and improved insulation property by increasing a breakdown voltage when compared to a case in which the insulation layer 500 is made of the polyimide. Also, the parylene may be filled between the coil patterns 310 and 320 at the uniform thickness along a gap between the patterns or formed at the uniform thickness along a stepped portion of the patterns. That is, when a distance between the patterns of the coil patterns 310 and 320 is far, the parylene may be applied at the uniform thickness along the stepped portion of the pattern. On the other hand, the distance between the patterns is near, the gap between the patterns may be filled to form the parylene at a predetermined thickness on the coil patterns 310 and 320. FIG. 5 is a cross-sectional views of the power inductor in which the insulation layer is made of polyimide, and FIG. 6 is a cross-sectional view of the power inductor in which the insulation layer is made of parylene. As illustrated in FIG. 6, in case of the parylene, although the parylene has a relatively thin thickness along the stepped portion of each of the coil patterns 310 and 320, the polyimide may have a thickness greater than that of the parylene as illustrated in FIG. 5. The insulation layer 500 may have a thickness of 3 μm to 100 μm by using the parylene. When the parylene is formed at a thickness of 3 μm or less, the insulation property may be deteriorated. When the parylene is formed at a thickness exceeding 100 μm, the thickness occupied by the insulation layer 500 within the same size may increase to reduce a volume of the body 100, and thus, the magnetic permeability may be deteriorated. Alternatively, the insulation layer 500 may be manufactured in the form of a sheet having a predetermined thickness and then formed on the coil patterns 310 and 320.

As described above, in the power inductor according to the first embodiment of the present invention, since the body 100 including the thermal conductive filler 130 in addition to the metal powder 110 and the polymer 120 is manufactured, the heat of the body 100 due to the heating of the metal powder 110 may be released to the outside to prevent the body from increasing in temperature and also prevent the inductance from being reduced. Also, since the insulation layer 500 is formed between the coil patterns 310 and 320 and the body 100 by using the parylene, the insulation layer 500 may be formed with a thin thickness on the side surface and the top surface of each of the coil patterns 310 and 320 to improve the insulation property. Also, since the base material 200 within the body 100 is made of the metal magnetic material, the decreases of the magnetic permeability of the power inductor may be prevented. Also, at least a portion of the base material 200 may be removed, and the body 100 may be filled into the removed portion to improve the magnetic permeability.

Figure 7:
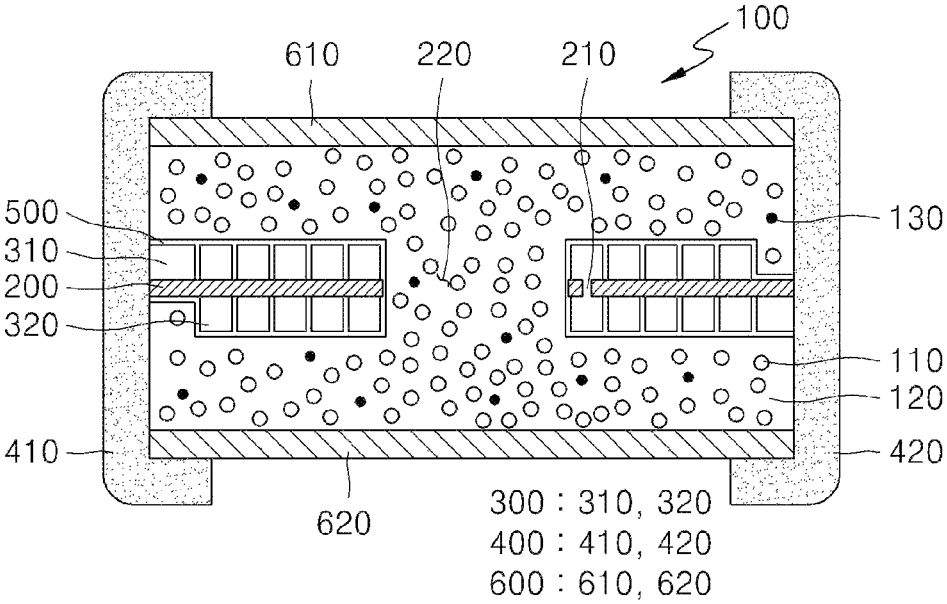
FIGS. 7 and 8 are cross-sectional views of a power inductor according to second embodiments of the present invention.

FIG. 7 is a perspective view of a power inductor according to a second embodiment of the present invention.

Referring to FIG. 7, a power inductor according to the second embodiment of the present invention may include a body 100 including a thermal conductive filler 130, a base material 200 provided in the body 100, coil patterns 310 and 320 disposed on at least one surface of the base material 200, external electrodes 410 and 420 provided outside the body 100, an insulation layer 500 provided on each of the coil patterns 310 and 320, and at least one magnetic layer 600 (610 and 620) provided on each of top and bottom surfaces of the body 100. That is, the second embodiment may be realized by further providing the magnetic layer 600 according to the first embodiment of the present invention. Hereinafter, constitutions different from those according to the first embodiment of the present invention will be mainly described according to the second embodiment of the present invention.

The magnetic layer 600 (610, 620) may be disposed on at least one area of the body 100. That is, a first magnetic layer 610 may be disposed on the top surface of the body 100, and the second magnetic layer 620 may be disposed on the bottom surface of the body 100. Here, the first and second magnetic layers 610 and 620 may be provided to improve magnetic permeability of the body 100 and also may be made of a material having magnetic permeability grater than that of the body 100. For example, the body 100 may have magnetic permeability of 20, and each of the first and second magnetic layers 610 and 620 may have magnetic permeability of 40 to 1000. Each of the first and second magnetic layers 610 and 620 may be manufactured by using, for example, magnetic powder and a polymer. That is, each of the first and second magnetic layers 610 and 620 may be made of a material having magnetism greater than that of the magnetic material of the body 100 or having a content of the magnetic material greater than that of the magnetic material of the body so as to have magnetic permeability greater than that of the body 100. Here, the polymer may be added to a content of 15 wt % with respect to 100 wt % of the metal powder. Also, the metal powder may use at least one selected from the group consisting of Ni ferrite, Zn ferrite, Cu ferrite, Mn ferrite, Co ferrite, Ba ferrite and Ni—Zn—Cu ferrite or at least one oxide magnetic material thereof. That is, the magnetic layer 600 may be formed by using metal alloy power including iron or metal alloy oxide containing iron. Also, a magnetic material may be applied to the metal alloy powder to form magnetic powder. For example, at least one oxide magnetic material selected from the group consisting of a Ni oxide magnetic material, a Zn oxide magnetic material, a Cu oxide magnetic material, a Mn oxide magnetic material, a Co oxide magnetic material, a Ba oxide magnetic material, and a Ni—Zn—Cu oxide magnetic material may be applied to the metal alloy powder including iron to form the magnetic powder. That is, the metal oxide including iron may be applied to the metal alloy powder to form the magnetic powder. Alternatively, at least one oxide magnetic material selected from the group consisting of a Ni oxide magnetic material, a Zn oxide magnetic material, a Cu oxide magnetic material, a Mn oxide magnetic material, a Co oxide magnetic material, a Ba oxide magnetic material, and a Ni—Zn—Cu oxide magnetic material may be mixed with the metal alloy powder including iron to form the magnetic powder. That is, the metal oxide including iron may be mixed with the metal alloy powder to form the magnetic powder. Each of the first and second magnetic layers 610 and 620 may further include a thermal conductive filler in addition to the metal powder and the polymer. The thermal conductive filler may be contained to a content of 0.5 wt % to 3 wt % with respect to 100 wt % of the metal powder. Each of the first and second magnetic layers 610 and 620 may be manufactured in the form of a sheet and disposed on each of the top and bottom surfaces of the body 100 on which the plurality of sheets are laminated. Also, paste made of a material including the metal powder 110, the polymer 120, and the thermal conductive filler 130 may be printed to a predetermined thickness or may be put into a frame and then compressed to form the body 100, thereby forming the first and second magnetic layers 610 and 620 on the top and bottom surfaces of the body 100. Also, each of the first and second magnetic layers 610 and 620 may be formed by using paste. That is, a magnetic material may be applied to the top and bottom surfaces of the body 100 to form the first and second magnetic layer 610 and 620.

Figure 8:
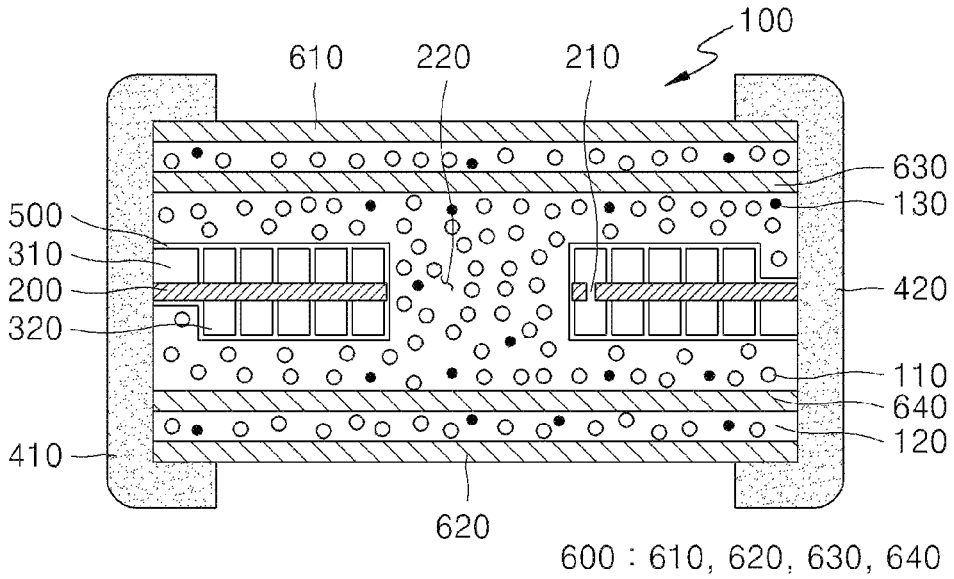

In the power inductor according to the second embodiment of the present invention, third and fourth magnetic layers 630 and 640 may be further provided between the first and second magnetic layers 610 and 620 and the base material 200 as illustrated in FIG. 8. That is, at least one magnetic layer 600 may be provided in the body 100. The magnetic layer 600 may be manufactured in the form of the sheet and disposed in the body 100 on which the plurality of sheets are laminated. That is, at least one magnetic layer 600 may be provided between the plurality of sheets for manufacturing the body 100. Also, when the paste made of the material including the metal powder 110, the polymer 120, and the thermal conductive filler 130 may be printed at a predetermined thickness to form the body 100, the magnetic layer may be formed during the printing. When the paste is put into a frame and then pressed, the magnetic layer may be disposed between the paste and the frame, and then, the pressing may be performed. Of course, the magnetic layer 600 may be formed by using the paste. Here, when the body 100 is formed, a soft magnetic material may be applied to form the magnetic layer 600 within the body 100.

As described above, in the power inductor according to another embodiment of the present invention, the at least one magnetic layer 600 may be provided in the body 100 to improve the magnetic permeability of the power inductor.

Figure 9:
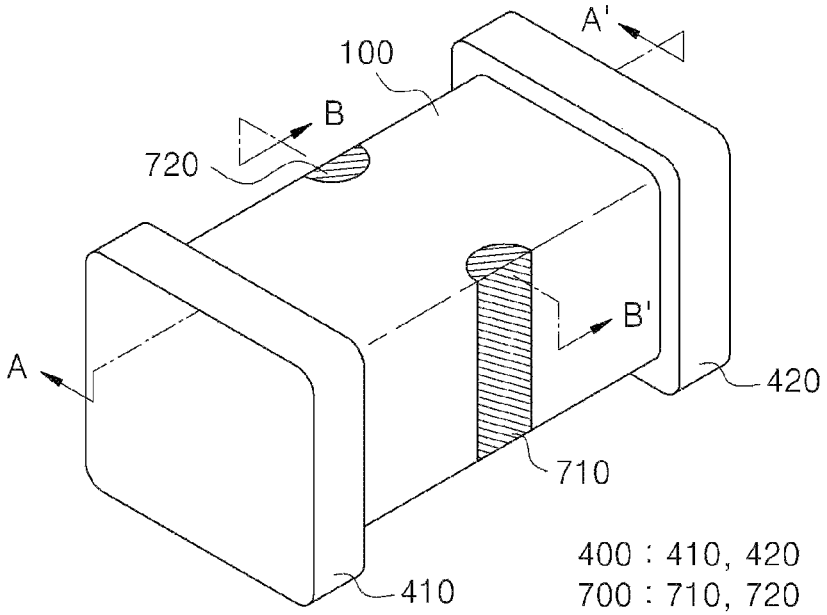
FIG. 9 is a perspective view of a power inductor according to a third embodiment of the present invention.
Figure 10:
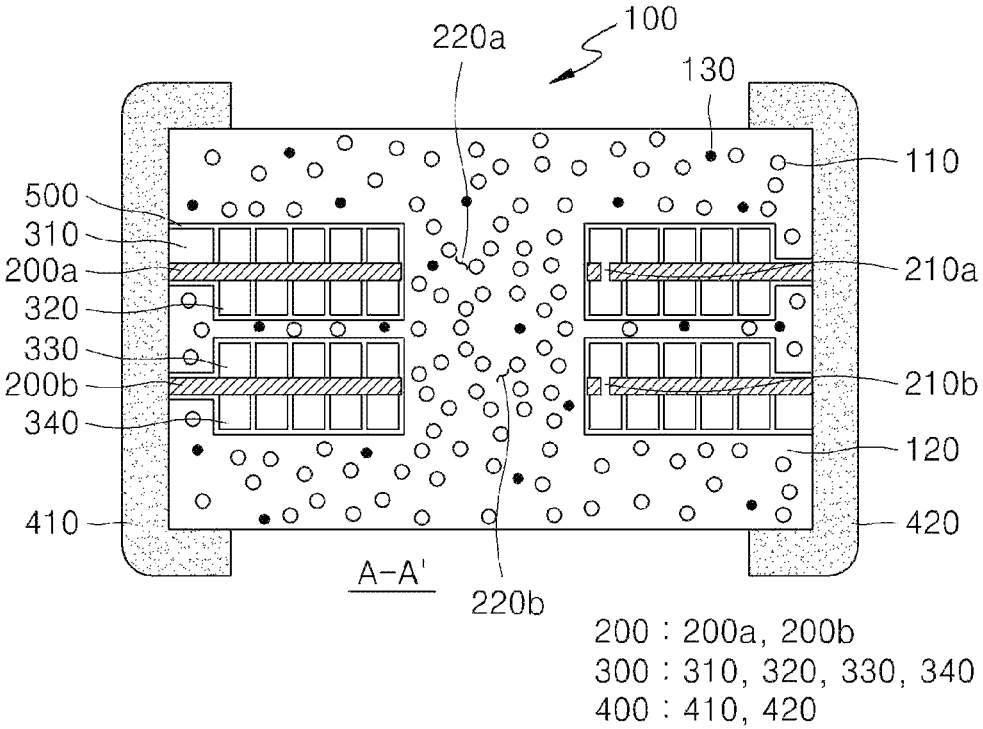
FIGS. 10 and 11 are cross-sectional views taken along lines A-A' and B-B' of FIG. 9, respectively.
Figure 11:
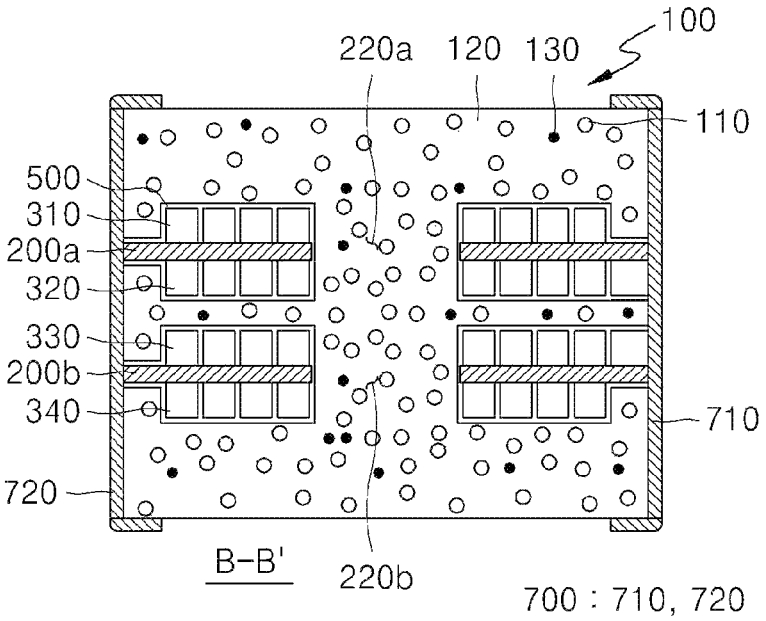

FIG. 9 is a perspective view of a power inductor according to a third embodiment of the present invention, FIG. 10 is a cross-sectional view taken along line A-A' of FIG. 9, and FIG. 11 is a cross-sectional view taken along line B-B' of FIG. 9.

Referring to FIGS. 9 to 11, a power inductor according to the third embodiment of the present invention may include a body 100, at least two base materials 200*a* and 200*b* (200) provided in the body 100, coil patterns 300 (310, 320, 330, and 340) disposed on at least one surface of each of the at least two base materials 200, external electrodes 410 and 420 disposed outside the body 100, an insulation layer 500 disposed on the coil patterns 500, and connection electrodes 700 (710 and 720) spaced apart from the external electrodes 410 and 420 outside the body 100 and connected to at least one coil pattern 300 disposed on each of at least two boards 300 within the body 100. Hereinafter, descriptions duplicated with those according to the first and second embodiments will be omitted.

The at least two base materials 200 (200*a* and 200*b*) may be provided in the body 100 and spaced a predetermined distance from each other a short axial direction of the body 100. That is, the at least two base materials 200 may be spaced a predetermined distance from each other in a direction perpendicular to the external electrode 400, i.e., in a thickness direction of the body 100. Also, conductive vias 210 (210*a* and 210*b*) may be formed in the at least two base materials 200, respectively. Here, at least a portion of each of the at least two base materials 200 may be removed to form each of through holes 220 (220*a* and 220*b*). Here, the through holes 220*a* and 220*b* may be formed in the same position, and the conductive vias 210*a* and 210*b* may be formed in the same position or positions different from each other. Of course, an area of the at least two base materials 200, in which the through hole 220 and the coil pattern 300 are not provided, may be removed, and then, the body 100 may be filled. Also, the body 100 may be disposed between the at least two base materials 200. The body 100 may be disposed between the at least two base materials 200 to improve magnetic permeability of the power inductor. Of course, since the insulation layer 500 is disposed on the coil pattern 300 disposed on the at least two base materials 200, the body 100 may not be provided between the base materials 200. In this case, the power inductor may be reduced in thickness.

The coil patterns 300 (310, 320, 330, and 340) may be disposed on at least one surface of each of the at least two base materials 200, preferably, both surfaces of each of the at least two base materials 200. Here, the coil patterns 310 and 320 may be disposed on lower and upper portions of a first substrate 200*a* and electrically connected to each other by the conductive via 210*a* provided in the first base material 200*a*. Similarly, the coil patterns 330 and 340 may be disposed on lower and upper portions of a second substrate 200*b* and electrically connected to each other by the conductive via 210*b* provided in the second base material 200*b*. Each of the plurality of coil patterns 300 may be formed in a spiral shape on a predetermined area of the base material 200, e.g., outward from the through holes 220*a* and 220*b* in a central portion of the base material 200. The two coil patterns 310 and 320 disposed on the base material 200 may be connected to each other to form one coil. That is, at least two coils may be provided in one body 100. Here, the upper coil patterns 310 and 330 and the lower coil patterns 320 and 340 of the base material 200 may have the same shape. Also, the plurality of coil patterns 300 may overlap each other. Alternatively, the lower coil patterns 320 and 340 may be disposed to overlap an area on which the upper coil patterns 310 and 330 are not disposed.

The external electrodes 400 (410 and 420) may be disposed on both ends of the body 100. For example, the external electrodes 400 may be disposed on two side surfaces of the body 100, which face each other in a longitudinal direction. The external electrode 400 may be electrically connected to the coil patterns 300 of the body 100. That is, at least one end of each of the plurality of coil patterns 300 may be exposed to the outside of the body 100, and the external electrode 400 may be connected to the end of each of the plurality of coil patterns 300. For example, the external electrode 410 may be connected to the coil pattern 310, and the external pattern 420 may be connected to the coil pattern 340. That is, the external electrode 400 may be connected to each of the coil patterns 310 and 340 disposed on the base materials 200*a* and 200*b*.

The connection electrode 700 may be disposed on at least one side surface of the body 100, on which the external electrode 400 is not provided. The connection electrode 700 may be disposed on at least one side surface of the body 100, on which the external electrode 400 is not provided. The external electrode 400 may be disposed on each of first and second side surfaces facing each other, and the connection electrode 700 may be disposed on each of third and fourth side surfaces on which the external electrode 400 is not provided. The connection electrode 700 may be provided to connect at least one of the coil patterns 310 and 320 disposed on the first base material 200*a* to at least one of the coil patterns 330 and 340 disposed on the second base material 200*b*. That is, the connection electrode 710 may connect the coil pattern 320 disposed below the first base material 200*a* to the coil pattern 330 disposed above the second base material 200*b* at the outside of the body 100. That is, the external electrode 410 may be connected to the coil pattern 310, the connection electrode 710 may connect the coil patterns 320 and 330 to each other, and the external electrode 420 may be connected to the coil pattern 340. Thus, the coil patterns 310, 320, 330, and 340 disposed on the first and second base materials 200*a* and 200*b* may be connected to each other in series. Although the connection electrode 710 connects the coil patterns 320 and 330 to each other, the connection electrode 720 may not be connected to the coil patterns 300. This is done because, for convenience of processes, two connection electrodes 710 and 720 are provided, and only one connection electrode 710 is connected to the coil patterns 320 and 330. The connection electrode 700 may be formed by immersing the body 100 into conductive paste or formed on one side surface of the body 100 through various methods such as printing, deposition, and sputtering. The connection electrode 700 may include a metal have electrical conductivity, e.g., at least one metal selected from the group consisting of gold, silver, platinum, copper, nickel, palladium, and an alloy thereof. Here, a nickel-plated layer (not show) and a tin-plated layer (not shown) may be further disposed on a surface of the connection electrode 700.

Figure 12:
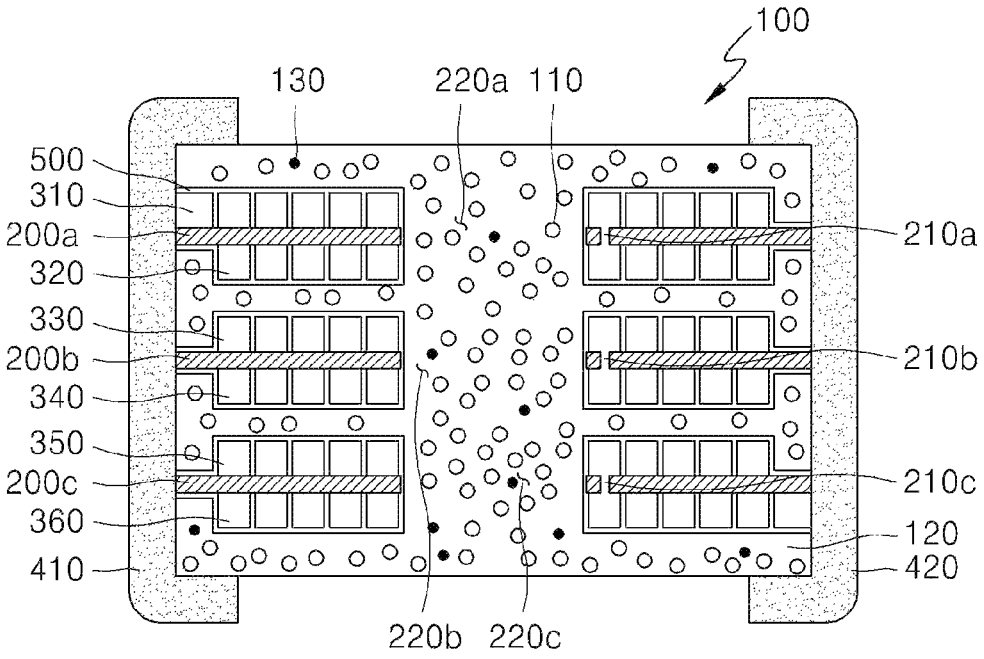
FIGS. 12 and 13 are cross-sectional views taken along lines A-A' and B-B' of FIG. 9 according to modified examples of the third embodiment of the present invention.
Figure 13:
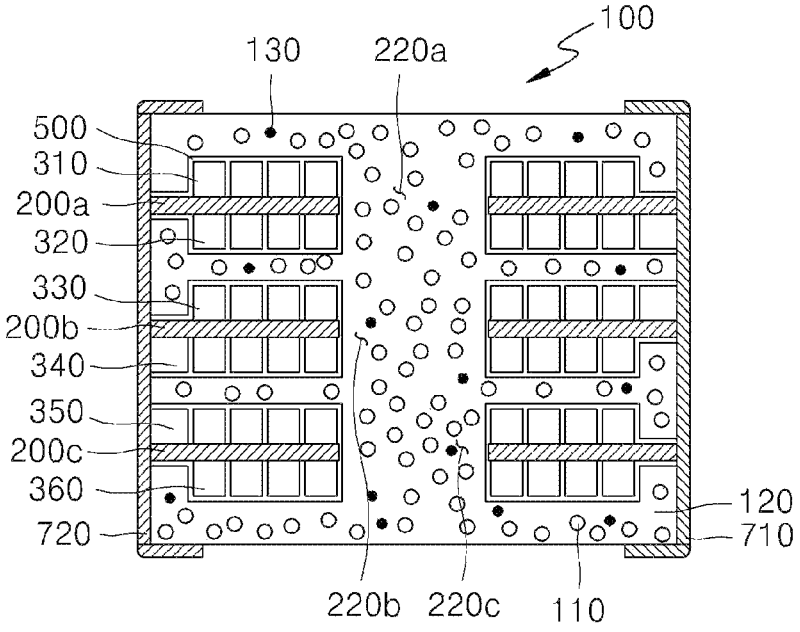

FIGS. 12 to 13 are cross-sectional views illustrating a modified example of a power inductor according to the third embodiment of the present invention. That is, three base materials 200 (200*a*, 200*b*, and 200*c*) may be provided in the body 100, coil patterns 300 (310, 320, 330, 340, 350, and 360) may be disposed on one surface and the other surface of each of the base materials 200, the coil patterns 310 and 360 may be connected to external electrodes 410 and 420, and coil patterns 320 and 330 may be connected to a connection electrode 710, and the coil patterns 340 and 350 may be connected to a connection electrode 720. Thus, the coil patterns 300 respectively disposed on the three base materials 200*a*, 200*b*, and 200*c* may be connected to each other in series by the connection electrodes 710 and 720.

As described above, in the power inductors according to the third embodiment and the modified example, the at least two base materials 200 on which each of the coil patterns 300 is disposed on at least one surface may be spaced apart from each other within the body 100, and the coil pattern 300 disposed on the other base material 200 may be connected by the connection electrode 700 outside the body 100. As a result, the plurality of coil patterns may be provided within one body 100, and thus, the power inductor may increase in capacity. That is, the coil patterns 300 respectively disposed on the base materials 200 different from each other may be connected to each other in series by using the connection electrode 700 outside the body 100, and thus, the power inductor may increase in capacity on the same area.

Figure 14:
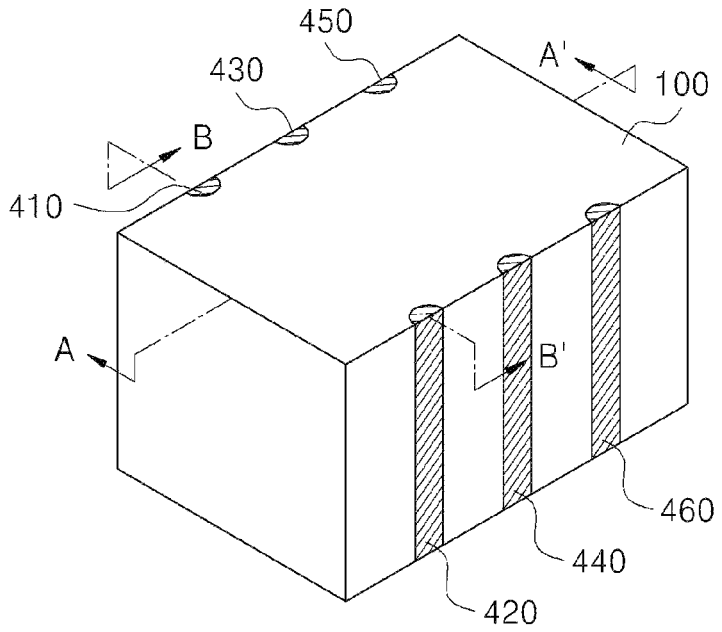
FIG. 14 is a perspective view of a power inductor according to a fourth embodiment of the present invention.
Figure 15:
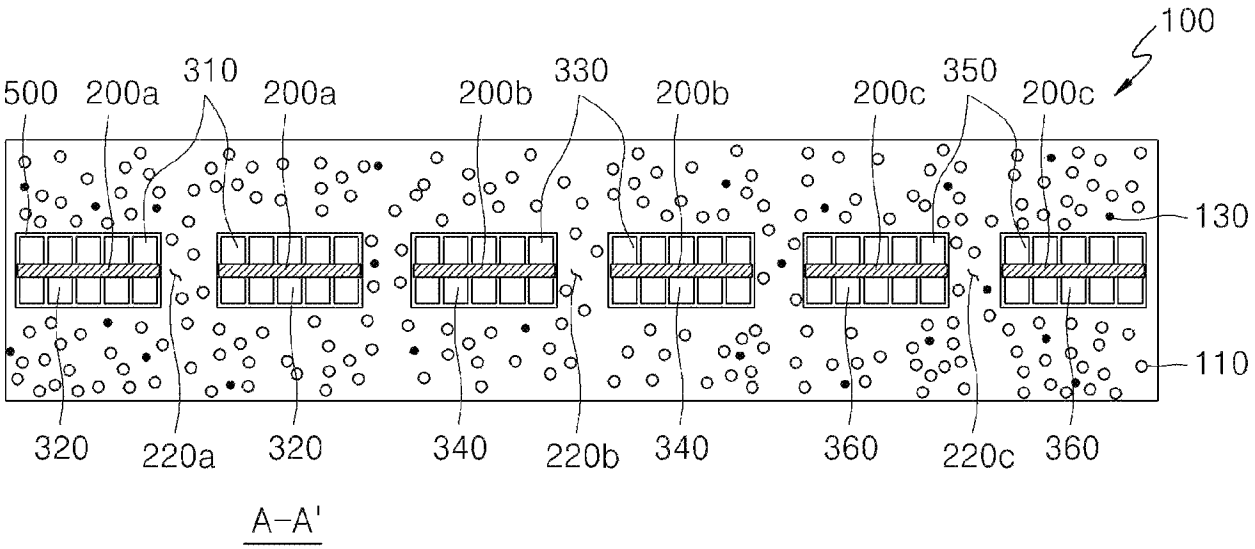
FIGS. 15 and 16 are cross-sectional views taken along lines A-A' and B-B' of FIG. 14, respectively.
Figure 16:
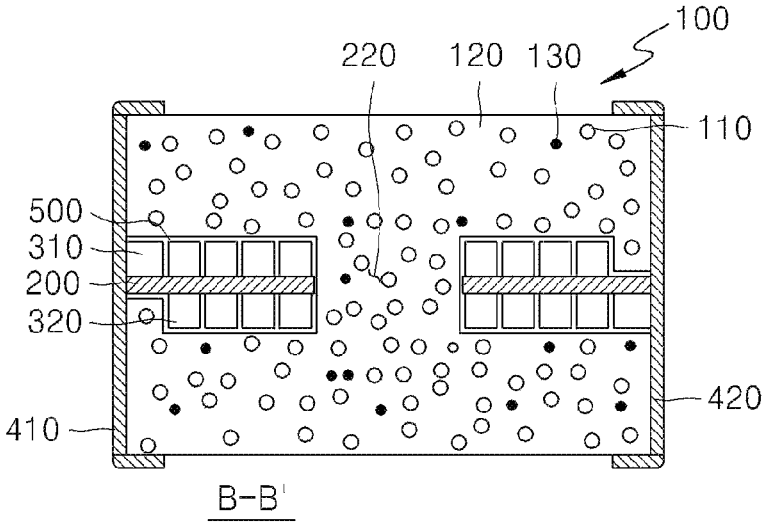
Figure 17:
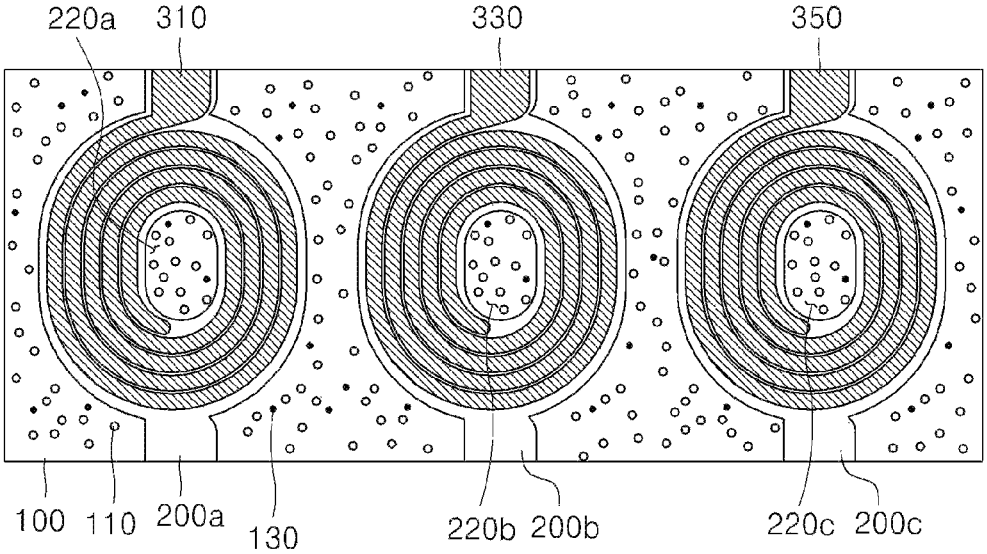
FIG. 17 is an internal plan view of FIG. 14.

FIG. 14 is a perspective view of a power inductor according to a fourth embodiment of the present invention, and FIGS. 15 and 16 are cross-sectional views taken along lines A-A' and B-B' of FIG. 14. Also, FIG. 17 is an internal plan view.

Referring to FIGS. 14 to 17, a power inductor according to the fourth embodiment of the present invention may include a body 100, at least two base materials 200 (200*a*, 200*b*, and 200*c*) provided in the body 100 in a horizontal direction, coil patterns 300 (310, 320, 330, 340, 350, and 360) disposed on at least one surface of each of the at least two base materials 200, external electrodes 400 (410, 420, 430, 440, 450, and 460) disposed outside the body 100 and disposed on the at least two base materials 200*a*, 200*b*, and 200*c*, and an insulation layer 500 disposed on the coil patterns 300. Hereinafter, descriptions duplicated with the foregoing embodiments will be omitted.

At least two, e.g., three base materials 200 (200*a*, 200*b*, and 200*c*) may be provided in the body 100. Here, the at least two base materials 200 may be spaced a predetermined distance from each other in a long axis direction that is perpendicular to a thickness direction of the body 100. That is, in the third embodiment of the present invention and the modified example, the plurality of base materials 200 are arranged in the thickness direction of the body 100, e.g., in a vertical direction. However, in the fourth embodiment of the present invention, the plurality of base materials 200 may be arranged in a direction perpendicular to the thickness direction of the body 100, e.g., a horizontal direction. Also, conductive vias 210 (210*a*, 210*b*, and 210*c*) may be formed in the plurality of base materials 200, respectively. Here, at least a portion of each of the plurality of base materials 200 may be removed to form each of through holes 220 (220*a*, 220*b*, and 220*c*). Of course, an area of the plurality of base materials 200, in which the through holes 220 and the coil patterns 300 are not provided, may be removed as illustrated in FIG. 17, and then, the body 100 may be filled.

The coil patterns 300 (310, 320, 330, 340, 350, and 360) may be disposed on at least one surface of each of the plurality of base materials 200, preferably, both surfaces of each of the plurality of base materials 200. Here, the coil patterns 310 and 320 may be disposed on one surface and the other surface of a first substrate 200*a* and electrically connected to each other by the conductive via 210*a* provided in the first base material 200*a*. Also, the coil patterns 330 and 340 may be disposed on one surface and the other surface of a second substrate 200*b* and electrically connected to each other by the conductive via 210*b* provided in the second base material 200*b*. Similarly, the coil patterns 350 and 360 may be disposed on one surface and the other surface of a third substrate 200*c* and electrically connected to each other by the conductive via 210*c* provided in the third base material 200*c*. Each of the plurality of coil patterns 300 may be formed in a spiral shape on a predetermined area of the base material 200, e.g., outward from the through holes 220*a*, 220*b*, and 200*c* in a central portion of the base material 200. The two coil patterns 310 and 320 disposed on the base material 200 may be connected to each other to form one coil. That is, at least two coils may be provided in one body 100. Here, the coil patterns 310, 330, and 350 that are disposed on one side of the base material 200 and the coil patterns 320, 340, and 360 that are disposed on the other side of the base material 200 may have the same shape. Also, the coil patterns 300 may overlap each other on the same base material 200. Alternatively, the coil patterns 320, 330, and 350 that are disposed on the one side of the base material 200 may be disposed to overlap an area on which the coil patterns 320, 340, and 360 that are disposed on the other side of the base material 200 are not disposed.

The external electrodes 400 (410, 420, 430, 440, 450, and 460) may be spaced apart from each other on both ends of the body 100. The external electrode 400 may be electrically connected to the coil patterns 300 respectively disposed on the plurality of base materials 200. For example, the external electrodes 410 and 420 may be respectively connected to the coil patterns 310 and 320, the external electrode 430 and 440 may be respectively connected to the coil patterns 330 and 340, and the external electrodes 450 and 460 may be respectively connected to the coil patterns 350 and 360. That is, the external electrodes 400 may be respectively connected to the coil patterns 300 and 340 disposed on the base materials 200*a*, 200*b*, and 200*c*.

As described above, in the power inductor according to the fourth embodiment of the present invention, the plurality of inductors may be realized in one body 100. That is, the at least two base materials 200 may be arranged in the horizontal direction, and the coil patterns 300 respectively disposed on the base materials 200 may be connected to each other by the external electrodes different from each other. Thus, the plurality of inductors may be disposed in parallel, and at least two power inductors may be provided in one body 100.

Figure 18:
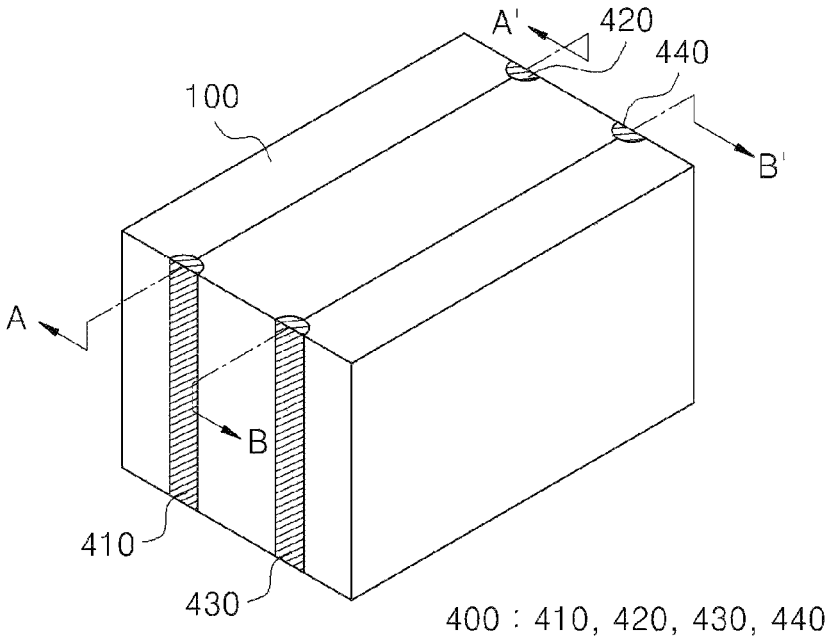
FIG. 18 is a perspective view of a power inductor according to a fifth embodiment of the present invention.
Figure 19:
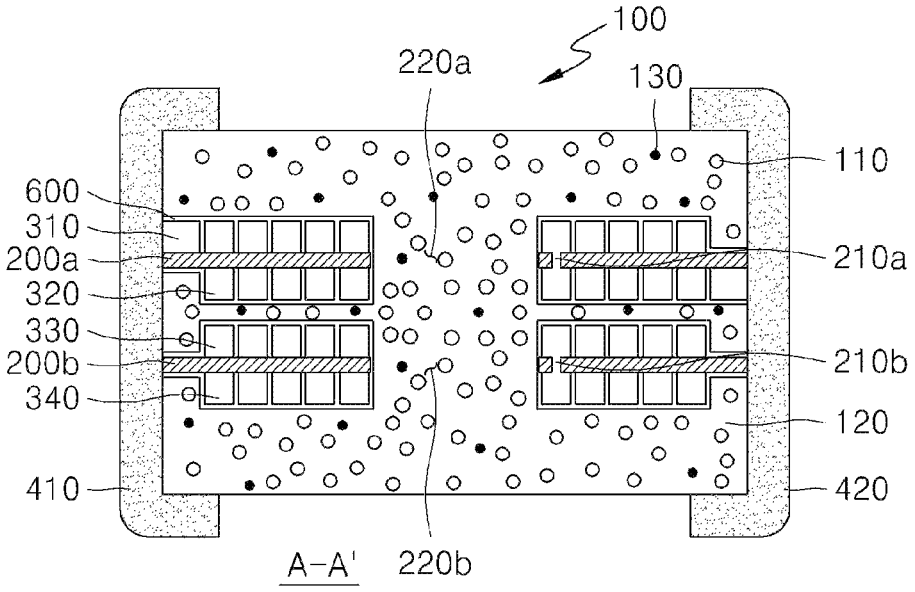
FIGS. 19 and 20 are cross-sectional views taken along lines A-A' and B-B' of FIG. 18, respectively.
Figure 20:
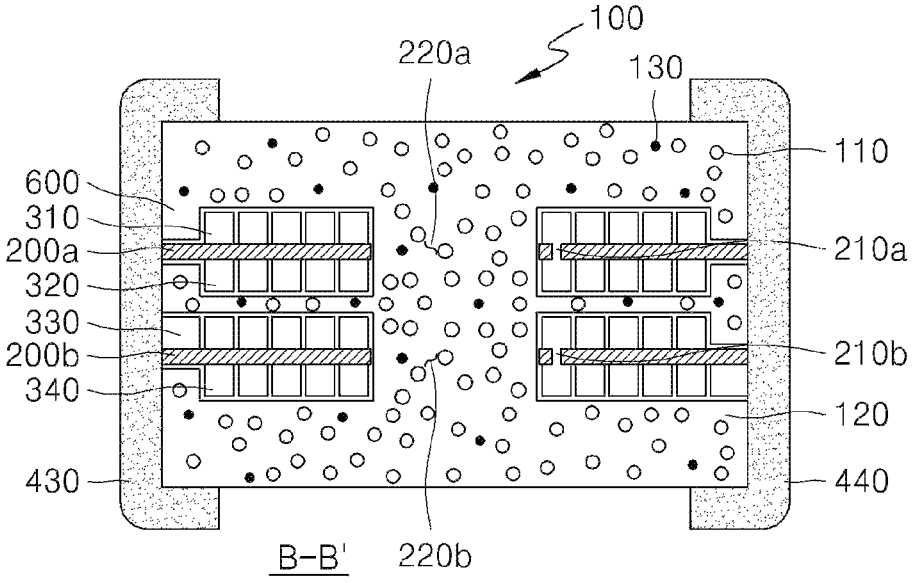

FIG. 18 is a perspective view of a power inductor according to a fifth embodiment of the present invention, and FIGS. 19 and 20 are cross-sectional views taken along lines A-A' and B-B' of FIG. 18.

Referring to FIGS. 18 to 20, a power inductor according to the fifth embodiment of the present invention may include a body 100, at least two base materials 200 (200*a* and 200*b*) provided in the body 100, coil patterns 300 (310, 320, 330, and 340) disposed on at least one surface of each of the at least two base materials 200, and a plurality of external electrodes 400 (410, 420, 430, and 440) disposed on two side surfaces facing of the body 100 and respectively connected to the coil patterns 310, 320, 330, and 340 disposed on the base materials 200*a* and 200*b*. Here, the at least two base materials 200 may be spaced a predetermined distance from each other and laminated in a thickness direction of the body 100, i.e., in a vertical direction, and the coil patterns 300 disposed on the base materials 200 may be withdrawn in directions different from each other and respectively connected to the external electrodes. That is, in the fourth embodiment of the present invention, the plurality of base materials 200 may be arranged in the horizontal direction. However, in the fifth embodiment of the present invention, the plurality of base materials may be arranged in the vertical direction. Thus, in the fifth embodiment of the present invention, the at least two base materials 200 may be arranged in the thickness direction of the body 100, and the coil patterns 300 respectively disposed on the base materials 200 may be connected to each other by the external electrodes different from each other, and thus, the plurality of inductors may be disposed in parallel, and at least two power inductors may be provided in one body 100.

As described above, in the third to fifth embodiments of the present invention, which are described with reference to FIGS. 9 to 20, the plurality of base materials 200, on which the coil patterns 300 disposed on the at least one surface within the body 10 are disposed, may be laminated in the thickness direction (i.e., the vertical direction) of the body 100 or arranged in the direction perpendicular to (i.e., the horizontal direction) the body 100. Also, the coil patterns 300 respectively disposed on the plurality of base materials 200 may be connected to the external electrodes 400 in series or parallel. That is, the coil patterns 300 respectively disposed on the plurality of base materials 200 may be connected to the external electrodes 400 different from each other and arranged in parallel, and the coil patterns 300 respectively disposed on the plurality of base materials 200 may be connected to the same external electrode 400 and arranged in series. When the coil patterns 300 are connected in series, the coil patterns 300 respectively disposed on the base materials 200 may be connected to the connection electrodes 700 outside the body 100. Thus, when the coil patterns 300 are connected in parallel, two external electrodes 400 may be required for the plurality of base materials 200. When the coil patterns 300 are connected in series, two external electrodes 400 and at least one connection electrode 700 may be required regardless of the number of base materials 200. For example, when the coil patterns 300 disposed on the three base materials 300 are connected to the external electrodes in parallel, six external electrodes 400 may be required. When the coil patterns 300 disposed on the three base materials 300 are connected in series, two external electrodes 400 and at least one connection electrode 700 may be required. Also, when the coil patterns 300 are connected in parallel, a plurality of coils may be provided within the body 100. When the coil patterns 300 are connected in series, one coil may be provided within the body 100.

Figure 21:
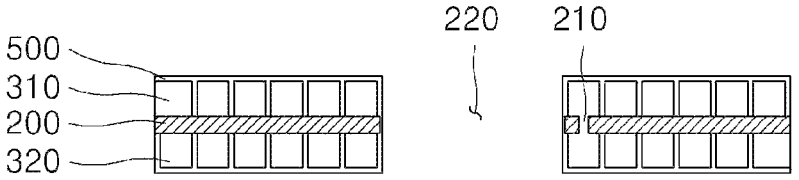
FIGS. 21 to 23 are cross-sectional views for sequentially explaining a method for manufacturing a power inductor according to an embodiment of the present invention.
Figure 22:
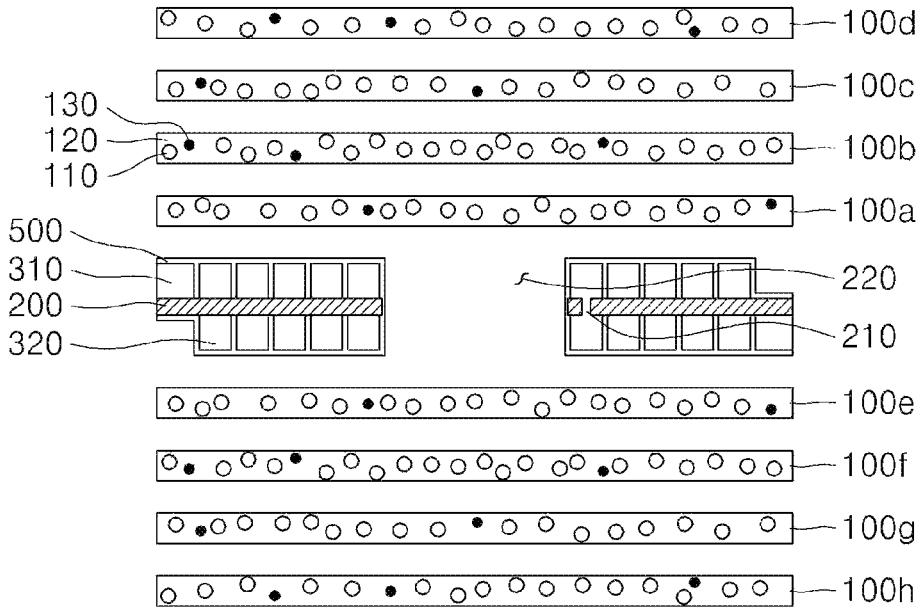
Figure 23:
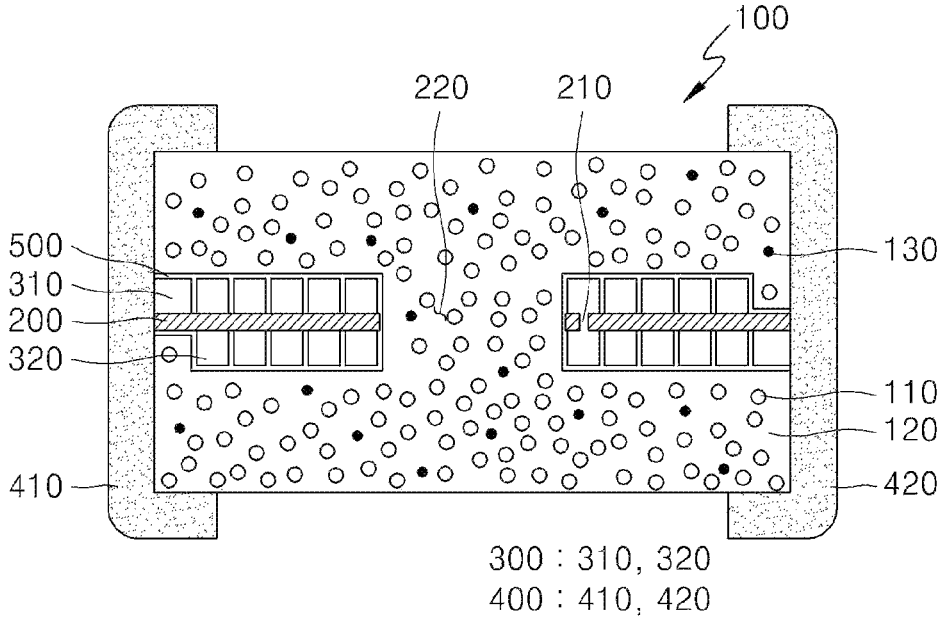

FIGS. 21 to 23 are cross-sectional views for sequentially explaining a method for the power inductor according to an embodiment of the inventive concept.

Referring to FIG. 21, coil patterns 310 and 320 each of which has a predetermined shape may be formed on at least one surface of a base material 200, i.e., one surface and the other surface of the base material 200. The base material 200 may be manufactured by using a CCL or metal magnetic material, preferably, a metal magnetic material that is capable of increasing effective magnetic permeability and facilitating relation of capacity. The base material 200 may be manufactured by using a CCL or metal magnetic material, preferably, a metal magnetic material that is capable of increasing effective magnetic permeability and facilitating relation of capacity. Here, a through hole 220 may be formed in a central portion of the base material 200, and a conductive via 201 may be formed in a predetermined region of the base material 200. Also, the base material 200 may have a shape in which an outer region except for the through hole 220 is removed. For example, the through hole 220 may be formed in a central portion of the base material having a rectangular shape with a predetermined thickness, and the conductive via 210 may be formed in the predetermined region. Here, at least a portion of the outside of the base material 200 may be removed. Here, the removed portion of the base material 200 may be outer portions of the coil patterns 310 and 320 formed in a spiral shape. Also, the coil patterns 310 and 320 may be formed on a predetermined area of the base material 200, e.g., in a circular spiral shape from the central portion. Here, the coil pattern 310 may be formed on one surface of the base material 20, and a conductive via 210 passing through a predetermined region of the base material 200 and filled with a conductive material may be formed. Then, the coil pattern 320 may be formed on the other surface of the base material 200. The conductive via 210 may be formed by filling conductive paste into a via hole after the via hole is formed in a thickness direction of the base material 200 by using laser. Also, the coil pattern 310 may be formed through, for example, a plating process. For this, a photosensitive pattern may be formed on one surface of the base material 200, and the plating process using the copper foil on the base material 200 as a seed may be performed to grow a metal layer from a surface of the exposed base material 200. Then, the photosensitive film may be reduced to form the coil pattern 310. Also, the coil pattern 320 may be formed on the other surface of the base material 200 through the same method as the coil pattern 310. The coil patterns 310 and 320 may be formed with a multilayer structure. When the coil patterns 310 and 320 have the multilayer structure, the insulation layer may be disposed between a lower layer and an upper layer. Then, a second conductive via (not shown) may be formed in the insulation layer to connect the multilayered coil patterns to each other. As described above, the coil patterns 310 and 320 may be formed on the one surface and the other surface of the base material 20, and then, an insulation layer 500 may be formed to cover the coil patterns 310 and 320. Also, the coil patterns 310 and 320 may be formed by applying an insulation polymer material such as parylene. Preferably, the insulation layer 500 may be formed on top and side surfaces of the base material 200 as well as top and side surfaces of the coil patterns 310 and 320 because of being coated with the parylene. Here, the insulation layer 500 may be formed on the top and side surfaces of the coil patterns 310 and 320 and the top and side surfaces of the base material 200 at the same thickness. That is, the base material 200 on which the coil patterns 310 and 320 are formed may be provided in a deposition chamber, and then, the parylene may be vaporized and supplied into the vacuum chamber to deposit the parylene on the coil patterns 310 and 320 and the base material 200. For example, the parylene may be primarily heated and vaporized in a vaporizer to become a dimer state and then be secondarily heated and pyrolyzed into a monomer state. Then, when the parylene is cooled by using a cold trap connected to the deposition chamber and a mechanical vacuum pump, the parylene may be converted from the monomer state to a polymer state and thus be deposited on the coil patterns 310 and 320. Here, a primary heating process for forming the dimer state by vaporized the parylene may be performed at a temperature of 100° C. to 200° C. and a pressure of 1.0 Torr. A secondary heating process for forming the monomer state by pyrolyzing the vaporized parylene may be performed at a temperature of 400° C. to 500° C. degrees and a pressure of 0.5 Torr. Also, the deposition chamber for depositing the parylene in a state of changing the monomer state into the polymer state may be maintained at a temperature of 25° C. and a pressure of 0.1 Torr. Since the parylene is applied to the coil patterns 310 and 320, the insulation layer 500 may be applied along a stepped portion between each of the coil patterns 310 and 320 and the base material 200, and thus, the insulation layer 500 may be formed with the uniform thickness. Of course, the insulation layer 500 may be formed by closely attaching a sheet including at least one material selected from the group consisting of epoxy, polyimide, and liquid crystal crystalline polymer to the coil patterns 310 and 320.

Referring to FIG. 22, a plurality of sheets 100*a* to 100*h* made of a material including the metal powder 110, the polymer 120, and the thermal conductive filler 130 are provided. Here, the metal powder 110 may use a metal material including iron (Fe), and the polymer 120 may use an epoxy and polyimide, which are capable of insulating the metal powder 110 from each other. The thermal conductive filler 130 may use MgO, AlN, and carbon-based materials, which are capable of releasing the heat of the metal powder 110 to the outside. Also, a surface of the metal powder 110 may be coated with the magnetic material, for example, a metal oxide magnetic material or coated with an insulation material such as parylene. Here, the polymer 120 may be contained at a content of 2.0 wt % to 5.0 wt % with respect to 100 wt % of the metal powder 110, and the thermal conductive filler 130 may be contained at a content of 0.5 wt % to 3 wt % with respect to 100 wt % of the metal powder 110. The plurality of sheets 100*a* to 100*h* are disposed on upper and lower portions of the base material 200 on which the coil patterns 310 and 320 are formed, respectively. The plurality of sheets 100*a* to 100*h* may have contents of the thermal conductive filler 130, which are different from each other. For example, the content of the thermal conductive filler 130 may gradually increase upward and downward from the one surface and the other surface of the base material 200. That is, the thermal conductive filler 130 of each of the sheets 100*b* and 100*e*, which are disposed above and below the sheets 100*a* and 100*d* contacting the base material 200, may have a content greater than that of the thermal conductive filler 130 of each of the sheets 100*a* and 100*d*, and the thermal conductive filler 130 of each of the sheets 100*c* and 100*f*, which are disposed above and below the sheets 100*b* and 100*e*, may have a content greater than that of the thermal conductive filler 130 of each of the sheets 100*b* and 100*e*. Since the content of the thermal conductive filler 130 increases in a direction that is away from the base material 200, thermal transfer efficiency may be more improved. Also, as proposed in another embodiment of the present invention, first and second magnetic layers 610 and 620 may be respectively disposed on top and bottom surfaces of the uppermost and lowermost sheets 100*a* and 100*h*. Each of the first and second magnetic layers 610 and 620 may be manufactured by using a material having magnetic permeability greater than that of each of the sheets 100*a* to 100*h*. For example, each of the first and second magnetic layers 610 and 620 may be manufactured by using magnetic powder and an epoxy resin so that the first and second magnetic layers 610 and 620 have magnetic permeability greater than those of the sheets 100*a* to 100*h*. Also, a thermal conductive filler may be further provided in each of the first and second magnetic layers 610 and 620.

Referring to FIG. 23, a plurality of sheets 100*a* to 100*h*, which are alternately disposed with the base material 200 therebetween, may be laminated and compressed and then molded to form the body 100. As a result, the body 100 may be filled into the through hole 220 of the base material 200 and the removed portion of the base material 200. Also, although not shown, each of the body 100 and the base material 200 may be cut into a unit of a unit device, and then the external electrode 400 electrically connected to the withdrawn portion of each of the coil patterns 310 and 320 may be formed on both ends of the body 100. The body 100 may be immersed into the conductive paste, the conductive paste may be printed on both ends of the body 10, or the deposition and sputtering may be performed to the form the external electrode 400. Here, the conductive paste may include a metal material that is capable of giving electrical conductive to the external electrode 400. Also, a Ni-plated layer and a Sn-plated layer may be further formed on a surface of the external electrode 400 as necessary.

The present invention may, however, be embodied in different forms and should not be construed as limited to the embodiments set forth herein. Rather, these embodiments are provided so that this disclosure will be thorough and complete, and will fully convey the scope of the present invention to those skilled in the art. Further, the present invention is only defined by scopes of claims.

The invention claimed is:

1. A power inductor comprising:

a body comprising a metal powder;

at least one base material provided in the body;

at least one coil pattern disposed on at least one surface of the base material; and an insulation layer disposed between the coil pattern and the body;

wherein at least a portion of the base material is removed, and the removed portion is filled with the body, wherein the insulation layer is formed in a thickness of 3 μm to 100 μm and with a uniform thickness along a stepped portion of the coil pattern, wherein the insulation layer is formed with a uniform thickness on a top surface and a side surface of the coil pattern and, at the same time, formed on a surface including the removed portion and a side surface of the base material with the same thickness as that of the insulation layer formed on the top surface and the side surface of the coil pattern; and wherein the metal powder has a surface coated with a first insulator formed of metal oxide, and a second insulator formed of parylene, wherein the second insulator is coated in a thickness of approximately 1 um to approximately 10 um.

2. The power inductor of claim 1, wherein the metal powder comprises metal alloy powder comprising iron.

3. The power inductor of claim 1, wherein a surface of the metal powder is further coated with a magnetic material.

4. The power inductor of claim 1, wherein the body further comprises, a polymer, and a thermal conductive filler.

5. The power inductor of claim 4, wherein the thermal conductive filler comprises at least one selected from the group consisting of MaO, AN, and carbon-based materials.

6. The power inductor of claim 5, wherein the thermal conductive filler has a content of 0.5 wt % to 3 wt % with respect to 100 wt % of the metal powder and has a size of 0.5 μM to 100 μm.

7. The power inductor of claim 1, wherein the base material is formed through copper clad lamination or formed by bonding copper foil on both surfaces of a metal plate.

8. The power inductor of claim 7, wherein the base material is manufactured by removing inner and outer regions of the coil pattern.

9. The power inductor of claim 8, wherein the base material has a concavely curved surface with respect to a side surface of the body by removing an entire outer region of the coil pattern.

10. The power inductor of claim 7, wherein the coil patterns are respectively disposed on one surface and the other surface of the base material and connected to each other through a conductive via defined in the base material.

11. The power inductor of claim 10, wherein the coil patterns disposed on the one surface and the other surface of the base material have the same height, which is greater by 2.5 times than a thickness of the base material.

12. The power inductor of claim 1, wherein the insulation layer is made of parylene.

13. The power inductor of claim 12, wherein the coil pattern is withdrawn to a central portion of two sides facing each other of the body and connected to an external electrode disposed outside the body.

14. The power inductor of claim 1, wherein at least two base materials are provided and laminated in a thickness direction of the body.

15. The power inductor of claim 14, wherein the coil patterns respectively disposed on the at least two base materials are connected in series or parallel to each other.

16. The power inductor of claim 15, wherein the coil patterns respectively disposed on the at least two base materials are connected to each other in series by a connection electrode disposed outside the body.

17. The power inductor of claim 15, wherein the coil patterns respectively disposed on the at least two base materials are withdrawn in directions different from each other and connected to external electrodes different from each other.

18. The power inductor of claim 1, wherein at least two base materials are provided and arranged in a direction perpendicular to a thickness direction of the body.

19. The power inductor of claim 18, wherein the coil patterns respectively disposed on the at least two base materials are withdrawn in directions different from each other and connected to external electrodes different from each other.

20. The power inductor of claim 1, further comprising a magnetic layer disposed on at least one area of the body and having magnetic permeability greater than that of the body.

21. The power inductor of claim 20, wherein the magnetic layer comprises a thermal conductive filler.

* * * * *